US012797674B2

(12) United States Patent
Valente et al.

(10) Patent No.: US 12,797,674 B2
(45) Date of Patent: Nov. 17, 2026

(54) FLOOR-BASED EXERCISE MACHINE CONFIGURATIONS

(71) Applicant: Tonal Systems, Inc., San Francisco, CA (US)

(72) Inventors: Michael Valente, San Francisco, CA (US); Robin Barata, San Francisco, CA (US); David Mallard, Mill Valley, CA (US); Thomas Kroman Watt, San Francisco, CA (US)

(73) Assignee: Tonal Systems, Inc., San Francisco, CA (US)

( * ) Notice: Subject to any disclaimer, the term of this patent is extended or adjusted under 35 U.S.C. 154(b) by 89 days.

(21) Appl. No.: 18/658,720

(22) Filed: May 8, 2024

(65) Prior Publication Data

US 2024/0316395 A1 Sep. 26, 2024

Related U.S. Application Data

(63) Continuation of application No. 18/375,297, filed on Sep. 29, 2023, now Pat. No. 12,017,108, which is a (Continued)

(51) Int. Cl.
*A63B 21/00* (2006.01)
*A63B 23/04* (2006.01)

(Continued)

(52) U.S. Cl.
CPC ..... *A63B 21/4033* (2015.10); *A63B 23/0458* (2013.01); *A63B 2024/0093* (2013.01);

(Continued)

(58) Field of Classification Search
CPC ..... A63B 21/4033; A63B 23/0458; A63B 2024/0093; A63B 2071/065;

(Continued)

(56) References Cited

U.S. PATENT DOCUMENTS 4,471,956 A 9/1984 Marlo
4,968,028 A 11/1990 Wehrell (Continued)

FOREIGN PATENT DOCUMENTS

EP 3202465 8/2017
KR 101160960 6/2012

(Continued)

OTHER PUBLICATIONS

Spool Definition & Meaning, Dictionary.com, https://www.dictionary.com/browse/spool#google_vignette, 2024, 1 page.

*Primary Examiner* — Andrew M Kobylarz
(74) *Attorney, Agent, or Firm* — Van Pelt, Yi & James LLP

(57) ABSTRACT

An exercise system includes a platform, a frame, a first stopper, and a second stopper. The platform includes a first vertically oriented motor and a second vertically oriented motor. The first vertically oriented motor is associated with a first cable and the second vertically oriented motor is associated with a second cable. The platform includes a front raised housing portion for the first vertically oriented motor and the second vertically oriented motor and a lower exercise portion on which a user utilizes the exercise machine to perform one or more different exercises. The frame that includes a first track that includes a first plurality of attachment points and a second track that includes a second plurality of attachment points. The first stopper is coupled to the first cable at a first attachment point. The first attachment point is capable of being vertically translated between the first plurality of attachment points. The second stopper is coupled to the second cable at a second attachment point.

13 Claims, 36 Drawing Sheets

Related U.S. Application Data continuation of application No. 18/237,843, filed on Aug. 24, 2023, now Pat. No. 12,285,648, which is a continuation of application No. 17/550,753, filed on Dec. 14, 2021, now Pat. No. 12,350,546.

(60) Provisional application No. 63/125,923, filed on Dec. 15, 2020.

(51) Int. Cl.
*A63B 24/00* (2006.01)
*A63B 71/06* (2006.01)

(52) U.S. Cl.
CPC . *A63B 2071/065* (2013.01); *A63B 2208/0204* (2013.01); *A63B 2225/50* (2013.01)

(58) Field of Classification Search
CPC ..... A63B 2208/0204; A63B 2225/50; A63B 21/153; A63B 2071/0081; A63B 2220/18; A63B 2220/20; A63B 2220/56; A63B 21/0058; A63B 21/154; A63B 21/156; A63B 21/4029
See application file for complete search history.

(56) References Cited

U.S. PATENT DOCUMENTS 4,998,721 A 3/1991 Anders
6,120,423 A 9/2000 Mackey
6,280,361 B1 8/2001 Harvey
6,312,363 B1 11/2001 Watterson
6,482,139 B1 11/2002 Haag
7,163,488 B2 * 1/2007 Anders ..... A63B 21/0724 482/4
7,278,958 B2 10/2007 Morgan
7,568,650 B2 8/2009 Barker
7,717,824 B2 5/2010 Pinto
7,753,830 B1 7/2010 Marsh
7,909,742 B2 * 3/2011 Ish, III ..... A63B 69/3623 482/92
8,029,425 B2 10/2011 Bronston
8,900,099 B1 12/2014 Boyette
9,101,791 B2 8/2015 Boyette
9,539,458 B1 * 1/2017 Ross ..... A63B 21/4043
9,814,920 B1 * 11/2017 Monterrey ..... A63B 21/0552
10,220,235 B2 3/2019 Norris
10,814,172 B1 * 10/2020 Ilfrey ..... A63B 23/035
11,007,398 B2 5/2021 Neuhaus
11,040,231 B2 * 6/2021 Rubin ..... A63B 71/0622
11,130,022 B1 * 9/2021 LoDuca ..... A63B 21/4029
11,298,577 B2 * 4/2022 Watterson ..... A63B 21/154
11,478,676 B2 * 10/2022 LoDuca ..... A63B 24/0087
11,504,570 B2 11/2022 Neuhaus
11,541,264 B1 1/2023 Mallard
12,090,359 B1 * 9/2024 Gonzalez ..... A63B 21/0058
12,285,649 B2 * 4/2025 Ye ..... A63B 21/4033
12,311,214 B2 * 5/2025 Mooney ..... A63B 21/4029
2004/0033866 A1 2/2004 Shapiro
2004/0242383 A1 12/2004 Karlstrom
2004/0254050 A1 12/2004 Morgan
2009/0029835 A1 1/2009 Ellis
2011/0275481 A1 11/2011 Greenhill
2012/0197168 A1 8/2012 Agrawal
2013/0303334 A1 11/2013 Adhami
2013/0310230 A1 * 11/2013 Norris ..... A63B 21/4035 482/115
2014/0038777 A1 2/2014 Bird
2014/0073492 A1 3/2014 Hunter
2015/0335951 A1 * 11/2015 Eder ..... G16H 20/30 482/8
2016/0101322 A1 4/2016 Potter
2016/0332019 A1 11/2016 Rollins
2016/0346601 A1 * 12/2016 Marcandelli ..... A63B 23/0244
2017/0027803 A1 2/2017 Agrawal
2017/0035642 A1 * 2/2017 Sugata ..... A63B 21/4035
2017/0319941 A1 * 11/2017 Smith ..... A63B 24/0003
2018/0021622 A1 1/2018 Holland
2018/0214729 A1 8/2018 Rubin
2018/0264306 A1 9/2018 Agrawal
2018/0296879 A1 10/2018 Blium
2019/0046830 A1 2/2019 Chiavegato
2019/0076691 A1 * 3/2019 Smith ..... A63B 23/1209
2019/0083351 A1 3/2019 Suzuki
2019/0344115 A1 11/2019 Neuhaus
2019/0344123 A1 * 11/2019 Rubin ..... A63B 21/153
2020/0047027 A1 2/2020 Ward
2020/0047030 A1 2/2020 Ward
2020/0047031 A1 * 2/2020 Orady ..... A63B 23/03541
2020/0047053 A1 2/2020 Ward
2020/0047054 A1 2/2020 Ward
2020/0047055 A1 * 2/2020 Ward ..... A61B 5/1114
2020/0054929 A1 2/2020 Ward
2020/0094096 A1 3/2020 Sorin
2020/0139186 A1 5/2020 Sorin
2020/0139187 A1 * 5/2020 Kennington ..... A63B 71/0622
2020/0197741 A1 6/2020 Lee
2020/0222266 A1 * 7/2020 Gordon ..... A61H 3/008
2020/0254295 A1 * 8/2020 Watterson ..... A63B 21/153
2020/0332990 A1 10/2020 Bayerlein
2021/0111646 A1 4/2021 Rubin
2021/0128978 A1 5/2021 Gilstrom
2021/0236874 A1 * 8/2021 Ward ..... A63B 24/0087
2021/0236876 A1 * 8/2021 Gregory ..... A63B 21/4035
2021/0339078 A1 11/2021 Akeel
2022/0062738 A1 * 3/2022 Neuhaus ..... A63B 71/0686
2022/0105378 A1 4/2022 Chiavegato
2022/0134171 A1 5/2022 Loduca
2022/0184452 A1 * 6/2022 Valente ..... A63B 21/0058
2022/0233907 A1 * 7/2022 Cobb ..... A63B 21/078
2022/0370854 A1 11/2022 Zhang
2022/0409950 A1 * 12/2022 Zhu ..... A63B 22/02
2023/0009699 A1 * 1/2023 Ferlito ..... A63B 24/0087
2023/0067732 A1 * 3/2023 Neuhaus ..... A63B 21/154
2023/0103725 A1 * 4/2023 Neuhaus ..... A63B 21/156 482/5
2023/0149778 A1 5/2023 Hendricks
2023/0166952 A1 6/2023 Hall
2023/0201652 A1 6/2023 Ye
2023/0241448 A1 * 8/2023 LoDuca ..... A63B 21/4035 482/99
2023/0405404 A1 * 12/2023 Belsham ..... A63B 24/0075
2024/0189651 A1 6/2024 Drayer
2025/0177800 A1 6/2025 Herring

FOREIGN PATENT DOCUMENTS

KR 101482222 1/2015
WO 2014139336 9/2014
WO 2021151127 8/2021

* cited by examiner

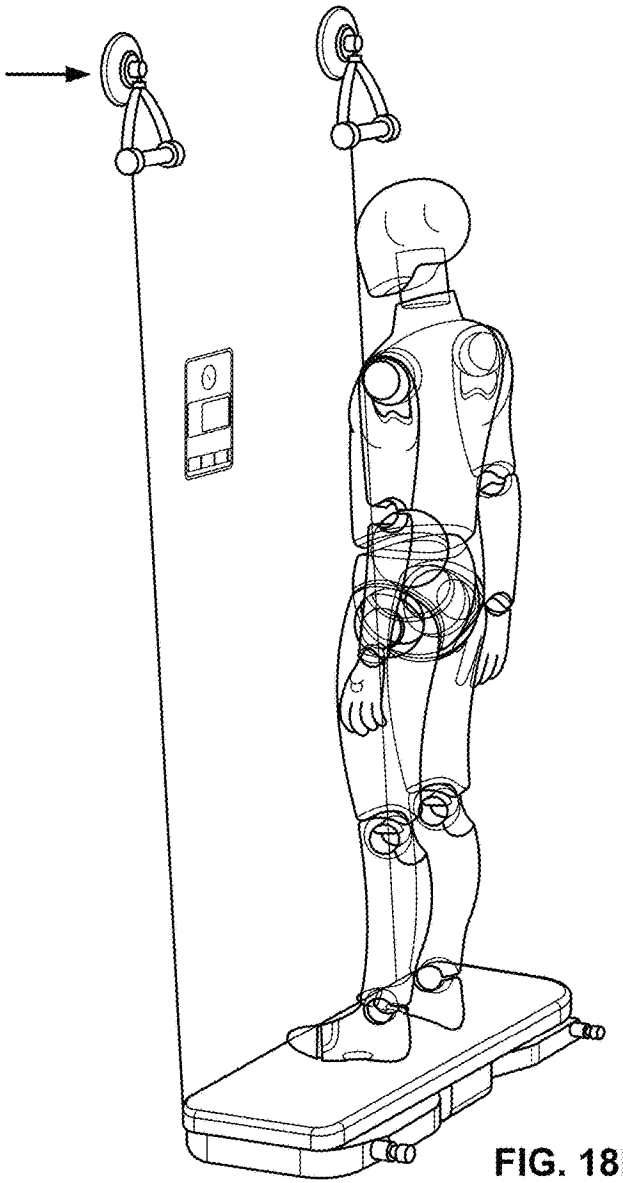
FIG. 18B
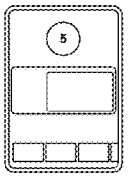
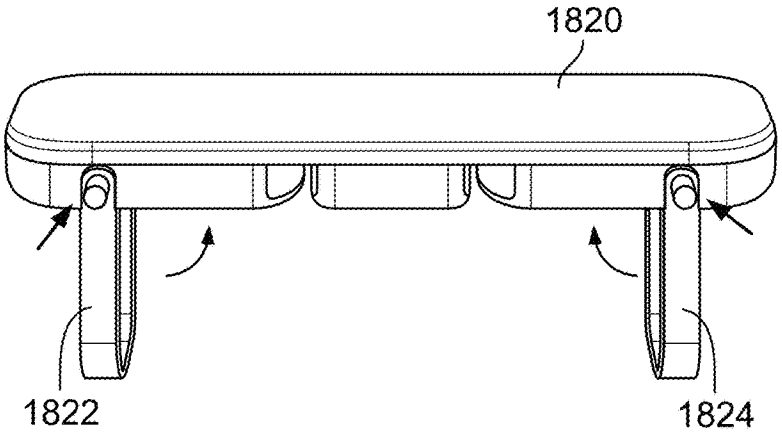

FLOOR-BASED EXERCISE MACHINE CONFIGURATIONS

CROSS REFERENCE TO OTHER APPLICATIONS

This application is a continuation of U.S. patent application Ser. No. 18/375,297 entitled FLOOR-BASED EXERCISE MACHINE CONFIGURATIONS filed Sep. 29, 2023, which is continuation of U.S. patent application Ser. No. 18/237,843 entitled FLOOR-BASED EXERCISE MACHINE CONFIGURATIONS filed Aug. 24, 2023, which is a continuation of U.S. patent application Ser. No. 17/550,753 entitled FLOOR-BASED EXERCISE MACHINE CONFIGURATIONS filed Dec. 14, 2021, which claims priority to U.S. Provisional Patent Application No. 63/125,923 entitled FLOOR-BASED EXERCISE MACHINE CONFIGURATIONS filed Dec. 15, 2020, each of which is incorporated herein by reference for all purposes.

BACKGROUND OF THE INVENTION

Strength training, also referred to as resistance training or weightlifting, is an important part of any exercise routine. It promotes the building of muscle, the burning of fat, and improvement of a number of metabolic factors including insulin sensitivity and lipid levels. It would be beneficial to have a strength training machine that is both accessible as well as capable of being configured in a variety of ways to perform various strength training exercises.

BRIEF DESCRIPTION OF THE DRA WINGS

Various embodiments of the invention are disclosed in the following detailed description and the accompanying drawings.

FIG. 18B illustrates an embodiment of a convertible platform and bench digital strength trainer.

DETAILED DESCRIPTION

Figure 1A:
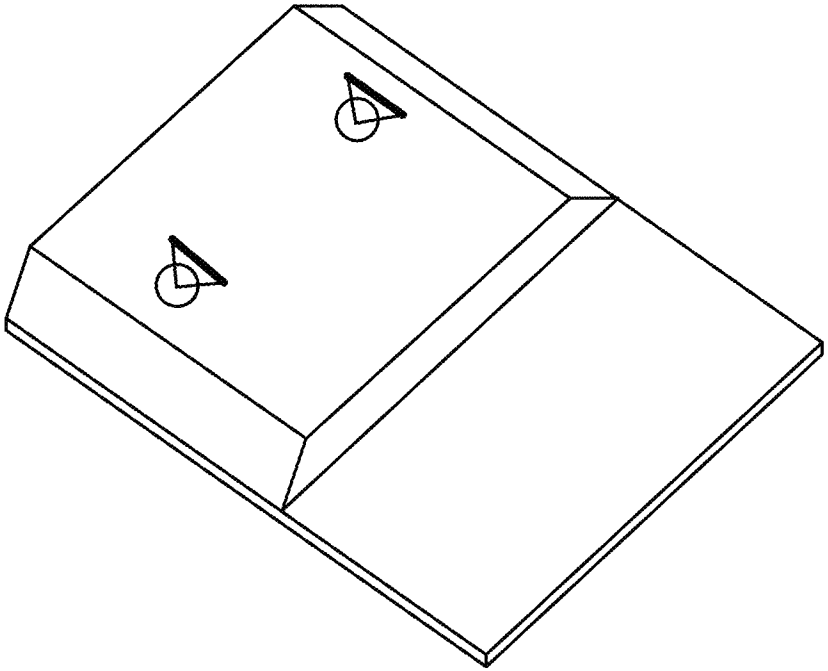
FIG. 1A illustrates an embodiment of a platform exercise machine.

The invention can be implemented in numerous ways, including as a process; an apparatus; a system; a composition of matter; a computer program product embodied on a computer readable storage medium; and/or a processor, such as a processor configured to execute instructions stored on and/or provided by a memory coupled to the processor. In this specification, these implementations, or any other form that the invention may take, may be referred to as techniques. In general, the order of the steps of disclosed processes may be altered within the scope of the invention. Unless stated otherwise, a component such as a processor or a memory described as being configured to perform a task may be implemented as a general component that is temporarily configured to perform the task at a given time or a specific component that is manufactured to perform the task. As used herein, the term 'processor' refers to one or more devices, circuits, and/or processing cores configured to process data, such as computer program instructions.

A detailed description of one or more embodiments of the invention is provided below along with accompanying figures that illustrate the principles of the invention. The invention is described in connection with such embodiments, but the invention is not limited to any embodiment. The scope of the invention is limited only by the claims and the invention encompasses numerous alternatives, modifications and equivalents. Numerous specific details are set forth in the following description in order to provide a thorough understanding of the invention. These details are provided for the purpose of example and the invention may be practiced according to the claims without some or all of these specific details. For the purpose of clarity, technical material that is known in the technical fields related to the invention has not been described in detail so that the invention is not unnecessarily obscured.

Described herein are embodiments of floor-based configurations of exercise machines such as digital strength trainers. In some embodiments, digital strength trainers include exercise machines in which a user's actuator (e.g., handle) is coupled via a cable to a motor. The torque on the motor is dynamically adjustable and controlled, for example, by a computer to make physical exercise more efficient, effective, safe, and/or enjoyable for a user. Described below are embodiments of digital strength trainers and digital strength training techniques. The disclosed floor-based configurations described below include configurations of digital strength trainers in which components such as motors are placed lower, such as near to or on the ground.

The floor-based configurations described herein have various benefits. For example, a floor-based configuration may be designed to not require arms that have degrees of freedom. The degrees of freedom of arms may be expensive (e.g., because the arms not only need to pass loads through them, but also be lockable and adjustable). Further, the use of arms may necessitate wall mounting of an exercise machine, which may introduce further installation cost and complexity. Thus, the removal or non-use of such degrees of freedom may allow for less expensive and complex exercise machines. However, as will be shown in the examples below, despite the removal of such degrees of freedom, compelling exercises may still be provided or facilitated with the floor-based digital exercise machine configurations described herein.

In some embodiments, in the floor-based configurations described herein that are used in conjunction with auxiliary pulleys, users of the digital exercise machines and digital strength trainers are configured to pull down on a cable coupled to a cable (e.g., retract cables downward toward the floor). In some embodiments, this mimics the action of weights pulling downwards.

Examples of floor-based digital exercise machines are described below, and include configurations in which the user stands on the exercise machine, sits on the exercise machine, etc.

One example of a floor-based configuration of a digital strength trainer is a platform or step. A platform configuration of a digital strength trainer has various benefits. For example, it may be portable since it need not be mounted. This allows the exercise machine to be stored away.

FIG. 1A illustrates an embodiment of a platform exercise machine. In some embodiments, the platform includes an internal motor coupled to a cable exiting the platform via a portal in an exit direction that transmits force to a remote handle. In some embodiments, the platform includes multiple internal motors coupled to respective cables exiting the platform via respective portals. For example, in the example of FIG. 1A, the platform may include two internal motors, each coupled to respective cables that transmit force to respective actuators (e.g., handles). As another example, the platform includes a single internal motor and a gearbox that allows power to be split to multiple cables.

Figure 1B:
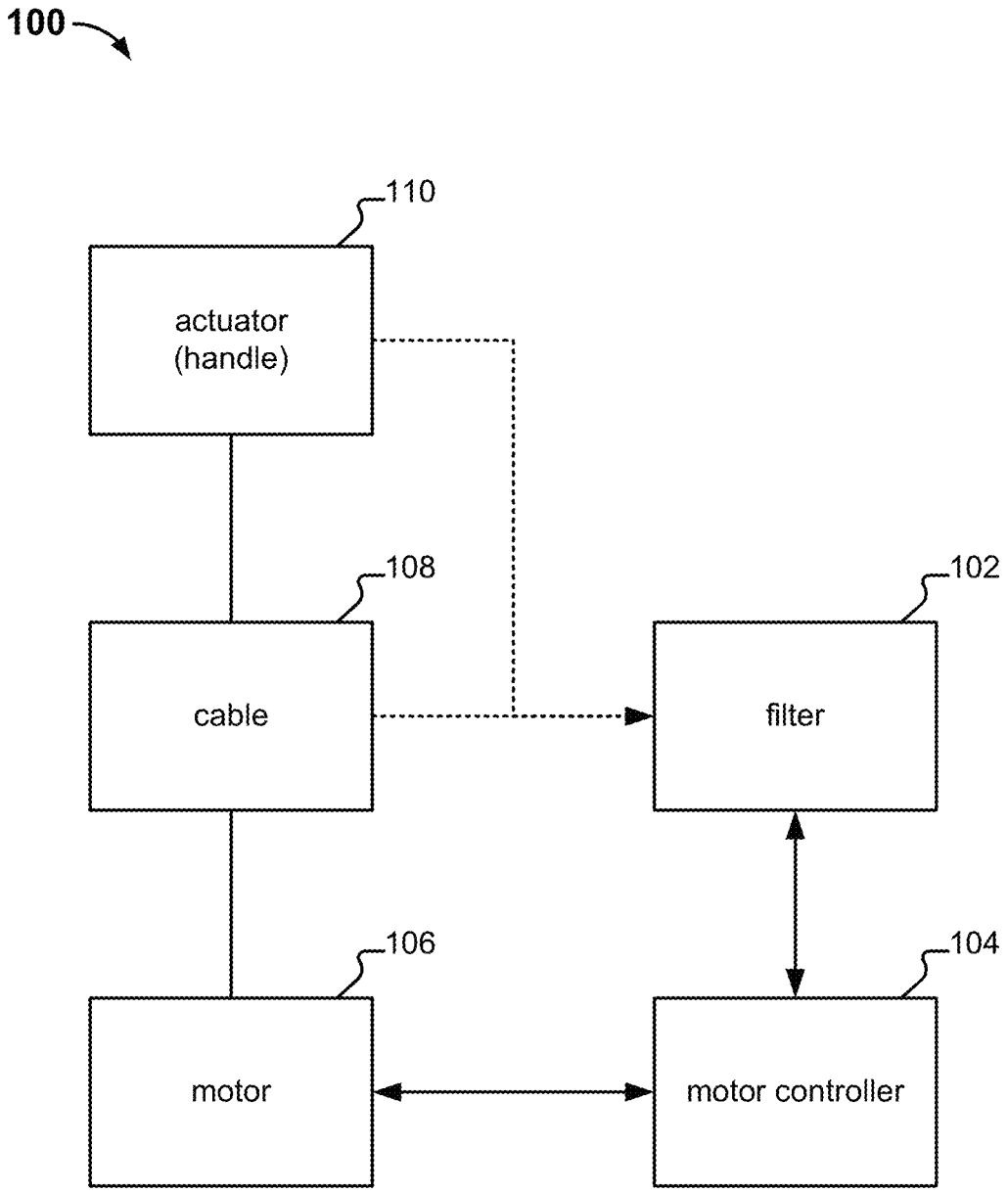
FIG. 1B is a block diagram illustrating an embodiment of an exercise machine.

FIG. 1B is a block diagram illustrating an embodiment of an exercise machine. In this example, system 100 (e.g., the platform exercise machine) includes the following:

- a controller circuit (104), which in various embodiments includes a processor, inverter, pulse-width-modulator, and/or a Variable Frequency Drive (VFD);
- a motor (106), for example, a three-phase brushless DC or induction AC motor, driven by the controller circuit. In some embodiments, the platform includes multiple motors;
- a spool with a cable (108) wrapped around the spool and coupled to the spool. On the other end of the cable an actuator/handle (110) is coupled in order for a user to grip and pull on. The spool is coupled to the motor (106) either directly or via a shaft/belt/chain/gear mechanism. A spool is also referred to herein as a "hub." In some embodiments, the platform includes multiple motors and multiple spools, where each spool has a cable wrapped around a given spool;
- a filter (102), to digitally control the controller circuit (104) based on receiving information from the cable (108) and/or actuator (110);
- in some embodiments, the exercise platform includes a gearbox between the motor and spool. Gearboxes multiply torque and/or friction, divide speed, and/or split power to multiple spools. Without changing the fundamentals of digital strength training, a number of combinations of motor and gearbox may be used to achieve the same end result. A cable-pulley system may be used in place of a gearbox; and
- in various embodiments, the exercise platform includes one or more of the following sensors:
  - a position encoder; a sensor to measure position of the actuator (110). Examples of position encoders include a hall effect shaft encoder, grey-code encoder on the motor/spool/cable (108), an accelerometer in the actuator/handle (110), optical sensors, position measurement sensors/methods built directly into the motor (106), and/or optical encoders. Other sensors that measure back-EMF (back electromagnetic force) from the motor (106) in order to calculate position may also be used;
  - a motor power sensor; a sensor to measure voltage and/or current being consumed by the motor (106); and
  - a user tension sensor; a torque/tension/strain sensor and/or gauge to measure how much tension/force is being applied to the actuator (110) by the user. In one embodiment, a tension sensor is built into the cable (108). Alternatively, a strain gauge is built into the motor mount holding the motor (106). As the user pulls on the actuator (110), this translates into strain on the motor mount which is measured using a strain gauge in a Wheatstone bridge configuration. In another embodiment, the cable (108) is guided through a pulley coupled to a load cell. In another embodiment, a belt coupling the motor (106) and cable spool or gearbox (108) is guided through a pulley coupled to a load cell. In another embodiment, the resistance generated by the motor (106) is characterized based on the voltage, current, or frequency input to the motor.

In some embodiments, the motor(s) (106) used in the exercise platform are three-phase brushless DC motors, which in various embodiments are used with the following:

- a controller circuit (104) combined with filter (102) including:
  - a processor that runs software instructions;
  - three pulse width modulators (PWMs), each with two channels, modulated at 20 kHz;
  - six transistors in an H-Bridge configuration coupled to the three PWMs;
  - optionally, two or three ADCs (Analog to Digital Converters) monitoring current on the H-Bridge; and/or
  - optionally, two or three ADCs monitoring back-EMF voltage;
- the three-phase brushless DC motor (106), which may include a synchronous-type and/or asynchronous-type permanent magnet motor, such that:
  - the motor (106) may be in an "out-runner configuration," used throughout this specification when the shaft is fixed and the body of the motor rotates, such as that used by an electric bike hub motor;
  - the motor (106) may have a maximum torque output of at least 60 Nm and a maximum speed of at least 300 RPMs; and
  - optionally, with an encoder or other method to measure motor position;
- a cable (108) wrapped around the body of the motor (106) such that the entire motor (106) rotates, so the body of the motor is being used as a cable spool in one embodiment. Thus, the motor (106) is directly coupled to a cable (108) spool. In one embodiment, the motor (106) is coupled to a cable spool via a shaft, gearbox, belt, and/or chain, allowing the diameter of the motor (106) and the diameter of the spool to be independent, as well as introducing a stage to add a set-up or step-down ratio if desired. Alternatively, the motor (106) is coupled to two spools with an apparatus in between to split or share the power between those two spools. Such an apparatus could include a differential gearbox, or a pulley configuration; and/or
- an actuator (110) such as a handle, a bar, a strap, or other accessory connected directly, indirectly, or via a connector such as a carabiner to the cable (108).

In some embodiments, the controller circuit (102, 104) is programmed to drive the motor in a direction such that it draws the cable (108) towards the motor (106). The user pulls on the actuator (110) coupled to cable (108) against the direction of pull of the motor (106).

One purpose of this setup is to provide an experience to a user similar to using a traditional cable-based strength training machine, where the cable is attached to a weight stack being acted on by gravity. Rather than the user resisting the pull of gravity, they are instead resisting the pull of the motor (106).

Note that with a traditional cable-based strength training machine, a weight stack may be moving in two directions: away from the ground or towards the ground. When a user pulls with sufficient tension, the weight stack rises, and as that user reduces tension, gravity overpowers the user and the weight stack returns to the ground.

By contrast, in a digital strength trainer, there is no actual weight stack. The notion of the weight stack is one modeled by the system. The physical embodiment is an actuator (110) coupled to a cable (108) coupled to a motor (106). A "weight moving" is instead translated into a motor rotating. As the circumference of the spool is known and how fast it is rotating is known, the linear motion of the cable may be calculated to provide an equivalency to the linear motion of a weight stack. Each rotation of the spool equals a linear motion of one circumference or $2\pi r$ for radius r. Likewise, torque of the motor (106) may be converted into linear force by multiplying it by radius r.

If the virtual/perceived "weight stack" is moving away from the ground, motor (106) rotates in one direction. If the "weight stack" is moving towards the ground, motor (106) rotates in the opposite direction. Note that the motor (106) is pulling towards the cable (108) onto the spool. If the cable (108) is unspooling, it is because a user has overpowered the motor (106). Thus, a distinction is noted between the direction the motor (106) is pulling and the direction the motor (106) is actually turning.

If the controller circuit (102, 104) is set to drive the motor (106) with a constant torque in the direction that spools the cable, corresponding to the same direction as a weight stack being pulled towards the ground, then this translates to a specific force/tension on the cable (108) and actuator (110). Referring to this force as "Target Tension," this force may be calculated as a function of torque multiplied by the radius of the spool that the cable (108) is wrapped around, accounting for any additional stages such as gear boxes or belts that may affect the relationship between cable tension and torque. If a user pulls on the actuator (110) with more force than the Target Tension, then that user overcomes the motor (106) and the cable (108) unspools moving towards that user, being the virtual equivalent of the weight stack rising. However, if that user applies less tension than the Target Tension, then the motor (106) overcomes the user and the cable (108) spools onto and move towards the motor (106), being the virtual equivalent of the weight stack returning.

Setting the controller circuit to drive the motor with constant torque is an example of a filter (102). Throughout this specification, the equations by which the controller circuit (104) is configured to drive the motor (106) are collectively referred to as a "filter." One example input of a filter is position, for example, position of the actuator (110) and/or cable (108). One example of a filter is one that drives the motor (106) with constant torque. An analogy to a digital strength training filter is a digital camera filter such as a sepia filter, or Polaroid filter, which includes equations that govern how the digital information from a camera sensor is processed to produce an image. Sometimes digital camera filters mimic something from the analog world such as film, which includes chemicals on plastic film that react to the exposure of light. Similarly, by way of digital control, a digital strength training filter may make the resulting system feel like a weight stack being acted on by gravity on planet Earth, a weight stack being acted on by gravity on the moon, a weight stack connected via a pulley system acted on by gravity on planet Earth, a spring, a pneumatic cylinder, or an entirely new experience.

The set of equations that describe the behavior of the motor (106) are its filter (102). This filter (102) ultimately affects how the system feels to a user, how it behaves to a user, and how it is controlled. A motor may be controlled in many ways: voltage, current, torque, speed, and other parameters. This is one aspect of a filter (102), where the filter includes equations that define the relationship between the intended behavior of the motor (106) relative to how the motor (106) is controlled.

The system described above with the controller circuit (104) being set to drive the motor (106) with constant torque is one example of a filter (102). Throughout this specification this filter is referred to as a "Constant Torque Filter." In such a case, the user experiences a fixed tension on the actuator (110) assuming low overall system friction. With a Constant Torque Filter, when the system is to behave like an ideal strength training machine with a weight corresponding to a mass m, then m is the specified Target Tension described above. The ideal strength training machine is considered ideal in the sense that it exhibits no friction, momentum, or inertia.

The Constant Torque Filter does not exhibit all of the characteristics of a weight stack acted on by gravity. Such a weight stack has to obey the equations of gravity, has momentum, and has a top speed achievable while falling. A filter mimicking such behavior is called a "Weight Stack Filter" throughout this specification.

In some embodiments, a Weight Stack Filter mirrors the behavior of a weight machine with a weight stack. The physics of such a machine may be described by a number of equations including:

$$F = m \cdot a \text{ or Force} = \text{Mass multiplied by Acceleration;}$$

Wherein: a=g (acceleration is the speed of gravity), and m is the mass of the weight stack, for the force F pulling the weight stack towards the ground.

The weight stack has two forces acting upon it: first, gravity pulling it to the ground; and second, tension from the cable (108) pulling it up. If the gravity force is greater than the tension, the weight stack moves towards the ground until it bottoms out and/or reaches ground position. If the tension force is greater, then the weight stack moves up away from the ground. If the two forces are equal, then the velocity/speed of the weight stack does not change. If the two forces are equal when the velocity is zero, then the weight stack remains suspended at a fixed position.

The weight stack also experiences friction, which applies in all three cases of the gravity force being greater than tension, gravity force being less than tension, and gravity force being equal to the tension force. The net force determines the acceleration that the weight stack experiences, which over time also determines its velocity, as velocity is the integral of acceleration over time. As F=m·a, or rearranged mathematically $$a = \frac{F}{m},$$

acceleration on the weight stack is the force it is experiencing divided by the mass. As described above, the weight stack experiences two forces added together: $F_1=-m \cdot g$ being the gravity force, with the negative convention because gravity is pulling down, and $F_2=Tg$ being the tension force, wherein g is used as the gauges are calibrated using weight with respects to the planet. That is, a 10 lb weight experiences less force on the moon because of the gravitational pull of the moon being lower. As all strain gauges are calibrated using a weight hanging against gravity on this planet, the g for gravity on earth is included in this equation.

Continuing the analytical solution, $F=F_1+F_2$, so as $$a = \frac{F}{m},$$

then $$a = \frac{F_1 + F_2}{m} = \frac{Tg - m \cdot g}{m} = \left(\frac{T}{m} - 1\right) \cdot g$$

To account for friction in a simple way, gravity g is multiplied by a number between 0 and 1, where a 1 indicates no friction and a 0 indicates so much friction that gravity is completely negated.

$$a = \frac{F_1 + F_2}{m} = \frac{Tg - m \cdot g}{m} = \left(\frac{T}{m} - 1\right) \cdot g \cdot r$$

wherein r is this friction factor.

In one embodiment, a value of r=0.7 is used from empirical data. This is a simple friction model for illustration. A more complex model may factor in speed, and different friction coefficients for static and dynamic friction. Any person having ordinary skill in the art may produce relevant equations as found in kinematics/physics textbooks.

For a Weight Stack Filter, the above equations define acceleration a as a function of tension T. To complete the Weight Stack Filter, this equation is related to the way the motor (106) is being controlled.

In one embodiment, tension Tis sampled every 10 milliseconds, that is, 100 times per second. In some embodiments, torque on the motor (106) is controlled using the same methods as the Constant Torque Filter. The equations above define the acceleration that the weight stack, and hence the user, experiences. At a rate of 100 times per second, tension Tis measured and acceleration a calculated, to adjust torque on the motor (106) such that motor (106) behaves in a manner consistent with that acceleration. At a rate of 100 times per second, motor position, directly or indirectly by measured cable or spool position, is measured. Velocity is then calculated as the change in position divided by the change in time of 10 ms. Acceleration is then calculated as the change in velocity divided by the change in time of 10 ms.

When measured acceleration is compared with the calculated acceleration governed by the equation, if measured acceleration is too high, then motor torque is increased. If the measured acceleration is too low, then motor torque is reduced. In one embodiment, both cases are performed using a PID loop.

In some embodiments, instead of measuring cable tension to calculate velocity, torque is calculated directly. In order to control torque of the motor (106) directly, a series of calculations are made to model the tension on a cable (108) of a weight stack moving. In this case, torque/tension is calculated as it is controlled by the controller. The tension on a cable (108) of a moving weight stack is not static, and varies with the speed/velocity and kinetic energy of the weight stack, which may be calculated by changes in potential energy.

The kinetic energy equation for a moving mass is:

$$E = \frac{1}{2} \cdot m \cdot v^2$$

and the potential energy of a weight stack is:

$$E = m \cdot g \cdot h$$

where m is the mass, g is the gravitational acceleration, and h is the height from the ground.

As energy expended/work between two points in time is force times distance:

$$W = \Delta E = F \cdot d$$

Combining these equations, the force exhibited by a moving weight stack is:

$$F = \frac{\frac{1}{2} \cdot m \cdot v_1^2 - \frac{1}{2} \cdot m \cdot v_2^2}{d}$$

Where $v_1$ is the velocity at the start of a time period, $v_2$ is the velocity at the end of a time period, and d is the distance the mass travels during that time period. Throughout this specification this equation is referred to as the "kinetic force equation."

Put another way:

if velocity of the mass did not change, then the tension experienced by a user is the standard tension of mass times gravity, or no change;

if the velocity of the mass increases, then the tension experienced by the user during that period of time is higher than just mass times gravity and is increased by the amount of the kinetic force equation; and if the velocity of the mass decreases, then the tension experienced by the user during that period of time is lower than just mass times gravity and is decreased by the amount of the kinetic force equation. For example, imagine a ball thrown up into the air at 1 meter per second. If a force continues to push up at the ball at mf it continues at the same velocity. If the force is less, the ball slows down. And, if the force is more, the ball speeds up. The equations reflect that instead of monitoring the velocity of the ball, it is determined how "heavy" the ball feels to the person pushing on it.

Force F as calculated in the above equation is the torque that is applied to the motor using the same method as that of the Constant Torque Filter.

Alternately, a simple equation to accomplish this is the standard relationship F=m·a: If the acceleration the weight stack experienced during a period of time is known, the net force/resistance that the user experiences may be calculated using this equation. The end result is the same, which may also be derived by using the kinetic force equation taking the limit as d goes to zero. Which equation is used in a particular embodiment depends on whether acceleration may be measured/calculated with enough accuracy.

In one embodiment, an adjustment loop is:

1. The torque on the motor (106) is set to be a force equivalent to m·g when coupled to a hub with a cable (108) wrapped around it. At this moment in time the cable (108) is already moving at a velocity.
2. A specified period of time later, for example, 5 ms, the velocity is measured and found to have changed in the positive direction, meaning that acceleration was experienced. This acceleration may be calculated by dividing the difference in velocity by the time period that has elapsed. Multiplying this acceleration by the gravitational constant yields the amount of additional force the motor supplies to the user. The torque on the motor is adjusted accordingly.

If the velocity was found to have reduced, then the torque is also reduced in response to negative acceleration.

If there is no change in velocity, that is acceleration is zero, then the torque maintains at mgr, where r is the radius of the hub, the equivalent of a force of m·g; and
3. Repeat this process.

This process represents a case when the weight stack is being pulled by a user away from the ground. If the weight stack is falling to the ground, the process is similar and acceleration is expected due to gravity. If the motor accelerates slower than gravity, it is because the user is resisting, and the force exerted by the motor/torque is adjusted accordingly such that F=m·g+m·a, where a is the additional acceleration from the user.

These equations facilitate a goal to model a weight stack. The benefits of a Weight Stack Filter are that it feels to a user like a traditional weight machine, and also allows the user to utilize kinetic energy, or energy that has been stored in the form of velocity, to their advantage to finish the exercise. However, some benefits to the user occur by not allowing them to store kinetic energy and later take it back, which some exercise professionals consider a form of cheating. Throughout this specification, the terms "torque" and "tension" are used interchangeably, as one may be calculated from the other-torque is tension multiplied by radius of the hub.

In a constant torque system, the motor (106) provides a fixed torque that is not adjusted by acceleration, and is set to a torque of mgr, which is not adjusted up or down based on changes in velocity and/or acceleration. Throughout this specification this is termed as "no cheat mode" or "momentum free mode." Some fitness experts suggest that a user should not be allowed to generate momentum because that reduces the amount of work required in the balance of the range of motion. The use of a no cheat mode is a trade-off between feeling "natural" and forcing the user to not cheat.

As an aside, another benefit of the gravity "natural" model of the Weight Stack Filter is that at times the user experiences tension in excess of ms. Some may not consider this cheating as it provides additional strain on the user. Hence, a "true no cheat mode" may be designed with the disclosed techniques that performs all of the calculations for the gravity model, and allows the case of additional tension during acceleration of the weight stack, but not the case of reduced tension during deceleration of the weight stack:

$$\text{torque} = m \cdot r \cdot (g + (0,\ a))$$

where (0, a) either selects 0 or positive values of a, acceleration, experienced by the weight stack as measured by changes in velocity of the cable/actuator (108, 110) attached to the hub.

Filters. As described earlier using the analogy of the digital camera to partially explain them, filters govern a specified behavior. To accomplish this, it often requires that this specified behavior be expressed in different forms of variables, and as such it becomes the responsibility of the filter to convert between these forms.

Motor Selection. The choice of whether to choose an induction motor or a BLDC, and the parameters of the chosen motor depends on cost, size, weight, thermal constraints, for example, how hot the motor gets and how is it cooled, and desired reliability and/or duty cycle. Whiles many motors exist that run in thousands of revolutions per second, an application such as fitness equipment designed for strength training has different requirements and is by comparison a low speed, high torque type application.

In one embodiment, a requirement of such a motor (106) is that a cable (108) wrapped around a spool of a given diameter, directly coupled to a motor (106), behave like a 200 lb weight stack, with the user pulling the cable at a maximum linear speed of 62 inches per second. A number of motor parameters may be calculated based on the diameter of the spool.

| Example User Requirements | |
|---|---|
| Target Weight | 200 lbs |
| Target Speed | 62 inches/sec = 1.5748 meters/sec |

| Example Requirements by Spool Size | | | | | | |
|---|---|---|---|---|---|---|
| | Diameter (inches) | | | | | |
| | 3 | 5 | 6 | 7 | 8 | 9 |
| RPM | 394.7159 | 236.82954 | 197.35795 | 169.1639572 | 148.0184625 | 131.5719667 |
| Torque (Nm) | 67.79 | 112.9833333 | 135.58 | 158.1766667 | 180.7733333 | 203.37 |
| Circumference (inches) | 9.4245 | 15.7075 | 18.849 | 21.9905 | 25.132 | 28.2735 |

Thus, a motor with 67.79 Nm of force and a top speed of 395 RPM, coupled to a spool with a 3 inch diameter meets these requirements. 395 RPM is slower than most motors available, and 68 Nm is more torque than most motors on the market as well.

Hub motors are three-phase permanent magnet BLDC direct drive motors in an "out-runner" configuration. In some embodiments, an out-runner configuration refers to the permanent magnets being placed outside the stator rather than inside, as opposed to many motors which have a permanent magnet rotor placed on the inside of the stator as they are designed for more speed than torque. Out-runners have the magnets on the outside, allowing for a larger magnet and pole count and are designed for torque over speed.

Hub motors also tend to be "pancake style," meaning they are higher in diameter and lower in depth than most motors. Pancake style motors are advantageous for a platform application, where maintaining a low depth is desirable, such as a piece of fitness equipment to be used in a consumer's home or in an exercise facility/area.

Motors may also be "direct drive," meaning that the motor does not incorporate or require a gear box stage. Many motors are inherently high speed low torque but incorporate an internal gearbox to gear down the motor to a lower speed with higher torque and may be called gear motors. Direct drive motors may be explicitly called as such to indicate that they are not gear motors.

If a motor does not exactly meet the requirements illustrated in the table above, the ratio between speed and torque may be adjusted by using gears or belts to adjust. A motor coupled to a 9" sprocket, coupled via a belt to a spool coupled to a 4.5" sprocket doubles the speed and halves the torque of the motor. Alternately, a 2:1 gear ratio may be used to accomplish the same thing. Likewise, the diameter of the spool may be adjusted to accomplish the same.

Alternately, a motor with 100× the speed and 100th the torque may also be used with a 100:1 gearbox. As such a gearbox also multiplies the friction and/or motor inertia by 100×, torque control schemes become challenging to design for fitness equipment/strength training applications. Friction may then dominate what a user experiences. In other applications friction may be present, but is low enough that it is compensated for, but when it becomes dominant, it is difficult to control. For these reasons, speed or position VUC are more appropriate for fitness equipment/strength training systems. For Position VUC, motors such as stepper motors may be good options. Stepper motors with a high holding torque may be controlled very accurately.

Position Control. One way to control motor position is to use a stepper motor. As well, three-phase brushless DC motors, brush DC motors, and/or induction motors may be precisely position controlled using methods such as a PID loop.

For a suitable stepper motor, position may be controlled directly. Stepper motors are controlled by pulses rather than voltage/current. The pulses command the motor to move one step at a time via shifting electromagnetic fields in the stator of the motor. A control system for a stepper motor is simpler to directly control position rather than velocity. While it is possible to control a stepper motor via velocity by controlling the frequency of the pulses being driven into the motor, position may be used in some embodiments.

The equations above describe velocity-based control, which may be analytically formed for position-based control as, similar to how velocity may be accumulated by summing acceleration over time, position may be accumulated by summing velocity over time.

$$p_{model_n} = p_{model_{n-1}} + v_{model} \cdot \Delta t$$

thus $$p_{error} = p_{actual} - p_{model}$$

which tells the controller how many pulses need to be sent to the motor to adjust its position.

In a position-based system, tension may be more easily controlled by adding elasticity, such as a spring, into the system. One example is a rotational spring added to the shaft referred to as a series elastic actuator. A series elastic actuator may be a spring integrated into the shaft between the motor/gearbox (106) and the hub, where the hub is the part that the cable (108) wraps around. If the hub remains in a fixed position, but the shaft rotates, hence increasing the tension on the spring, that additional tension translates into tension on the cable, or if the motor shaft remains fixed and the hub rotates a similar occurrence happens.

Hence, if the position of the motor (106) and the position of the hub are measured, then tension may be easily inferred using the characteristics of the spring mechanism. Likewise, if tension were measured directly using a strain gauge for example, then the relative position of the hub to the shaft may be easily calculated. A stepper motor may directly control tension in the system by controlling the relative position of the motor (106) as compared to the hub. In one embodiment, the controller (104) calculates a desired relative position between the hub and the shaft in order to produce the tension desired, compares that to the current relative position between the hub and the shaft, then sends the appropriate number of pulses to the stepper motor (106) to adjust its position to match.

The above description is for a sample embodiment with certain characteristics, and demonstrates certain calculations and design parameters/techniques/philosophies. Any person having ordinary skill in the art of motor-driven system design may perform these calculations using standard equations and make trade-off based decisions to arrive at a final design including selecting which variables to control using a control system.

Position Measurement. Motor position may be measured using a number of methods, including:

- Hall Sensors: Hall sensors mounted to the stator of the motor may track the position of the magnets relative to the stator. Signals from these sensors may be measured to determine the position of the motor, for example, by using an analog to digital convertor (ADC) to track the sinusoidal waveform generated as the magnet passes by a Hall sensor and characterizing the position of the motor relative to a point in the waveform, or by digitally counting the magnets as they move past the Hall sensors;
- Encoder: An encoder coupled to the physical rotation of the motor measures motor movement and reports it using digital pulses. An example of such an encoder is a Quadrature Encoder. Some quadrature encoders rely on electrical connections such as brushes, others use optical sensors, and others rely on magnets and Hall sensors;
- Indirect: Movement of the motor (106) may be measured indirectly by measuring the movement of anything the motor is coupled to, such as a belt, chain, shaft, gearbox, and so forth;
- Voltage: Back-EMF voltage generated by a motor may indicate motor position under certain circumstances; and/or
- Other: Other techniques may be used to measure the position and movement of a motor. However, different techniques may exhibit different characteristics such as: i) accuracy [resolution], ii) delay, iii) sampling rate. The required set of characteristics depends on the filter being used.

While embodiments of a platform exercise device including pancake motors are described herein for illustrative purposes, the platform exercise devices described herein may be variously adapted to accommodate any other type of motor, as appropriate. In the following examples, platforms that include two internal motors and two actuators are described. In the below examples, platforms including dual motors are described for illustrative purposes. In other embodiments, the platform includes a single motor, where a differential is used to allow the two cables to move independently of each other. In some embodiments, differentials (e.g., pulley differentials) are used to allow the same cable to be used for multiple pull points. In some embodiments, each pull point has its own separate cable. In some embodiments, each pull point is associated with its own individual motor.

The motors internal to the platform may be mounted in various orientations. Details regarding embodiments of vertical and horizontal mounting of motors are described below.

Vertically Mounted Motors

In some embodiments, the motors are each oriented/mounted vertically within the platform.

Figure 2:
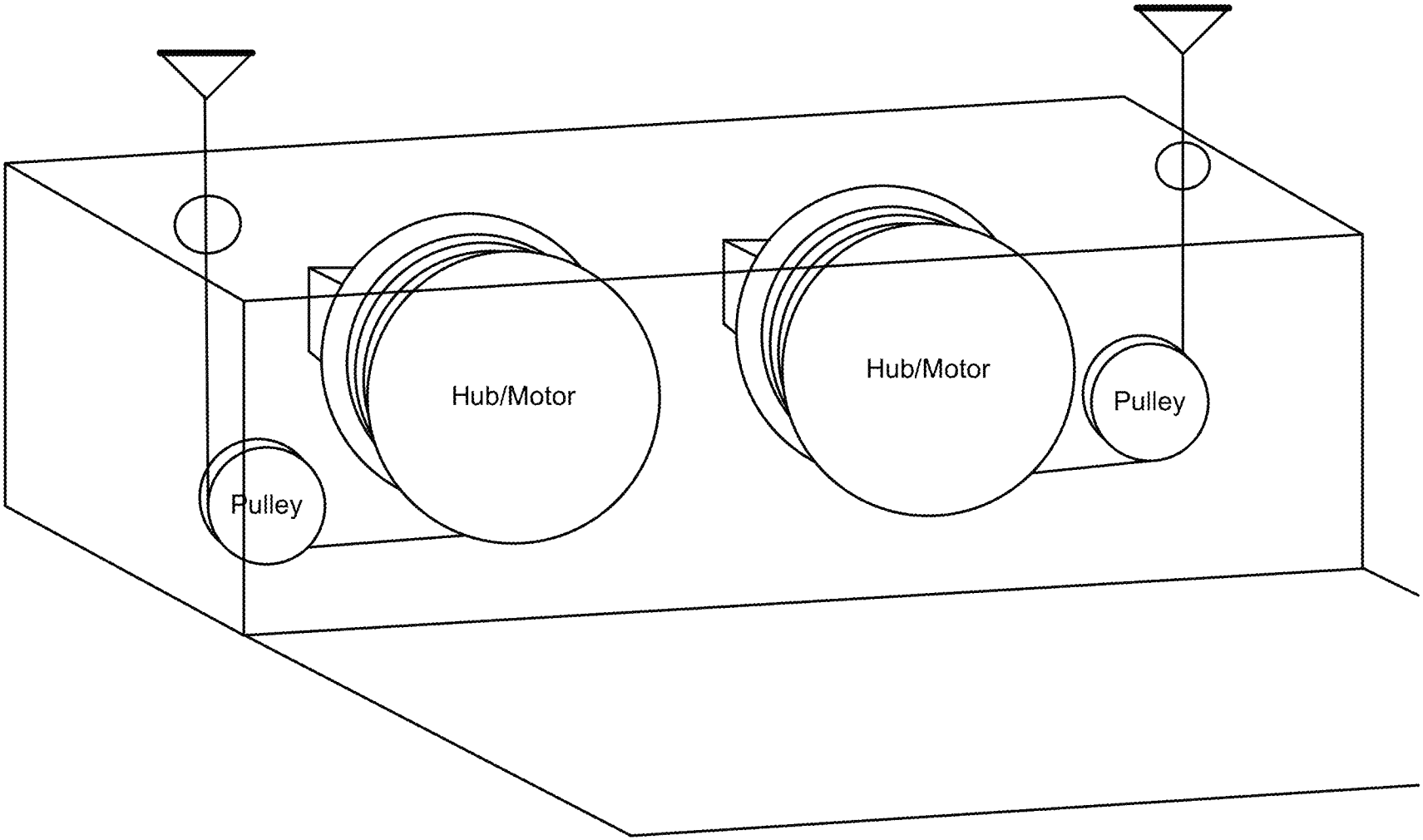
FIG. 2 illustrates an embodiment of a platform including vertically mounted motors.

FIG. 2 illustrates an embodiment of a platform including vertically mounted motors. In some embodiments, a vertically mounted motor is mounted within the platform such that its axis of rotation passes through a front of the platform. A combined hub and motor configuration is shown in the example of FIG. 2.

One benefit of the vertical mounting of the motors is the reduction in numbers of pulleys. In some embodiments, the cable directly spools on the motor and exits out of the platform, without the need for intermediary pulleys (e.g., to translate from horizontal to vertical if using a horizontally mounted motor).

Motor Placement

Given the height of the motors when mounted vertically, consideration may be made as to where the motors are placed ergonomically in the platform so that its placement does not limit too many movements.

In some embodiments, the motors and electronics are housed in a "bulge," where the platform also includes a larger plate that is lower to the ground that the user stands on.

In some embodiments, to accommodate the height of the vertically mounted motors, the platform includes a raised portion, where the raised portion is a localized area of the platform that is thicker that houses the motors. The platform may also include a thinner portion.

In this example, the platform includes a raised portion and a lower portion that is a flat plane. Components such as motors are included in the raised portion of the platform.

In some embodiments, when the platform is placed against a wall, the user may place their feet against a front of the raised portion of the platform, allowing them to perform exercises such as seated rows. The raised portion may also be used for exercises such as step ups. Thus, both high and low levels of the exercise platform may be utilized.

Internal Cable Routing

In some embodiments, with the motors mounted vertically, each cable is also spooled vertically. In this configuration, each cable runs through the inside of the platform and up out of a respective exit point or portal in the top surface of the platform.

Horizontally Mounted Motors

In another embodiment, the motors are each oriented/mounted horizontally. In some embodiments, a horizontally mounted motor is mounted within the platform such that its axis of rotation passes through a top and bottom of the platform. Horizontal mounting of the motors allows for a lower profile platform (without, for example, the need for a raised portion or a tall platform to accommodate vertically mounted motors).

A lower platform provides various benefits, such as with respect to flexibility. For example, a lower platform is easier to store. As another example, a lower platform provides a user with a greater sense of stability.

Figure 3:
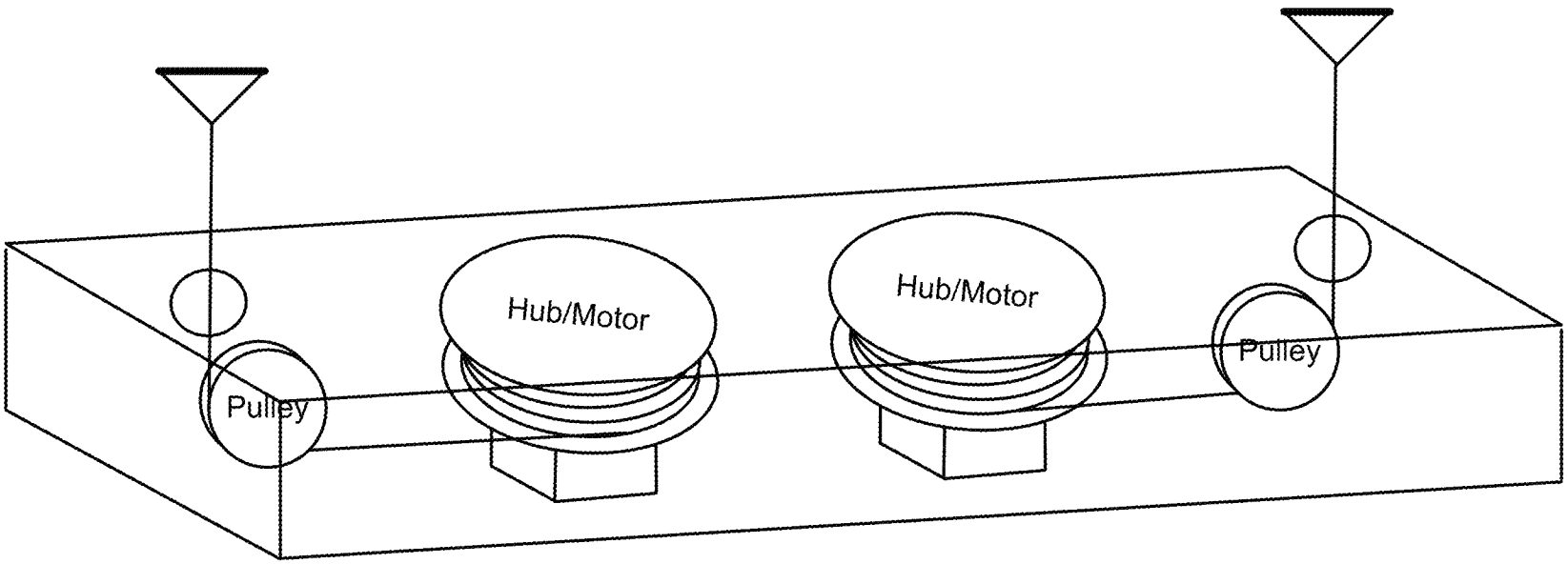
FIG. 3 illustrates an embodiment of a platform including horizontally mounted motors.

FIG. 3 illustrates an embodiment of a platform including horizontally mounted motors. In this example, relative to the vertically mounted motors described above, the horizontally mounted motors are turned sideways, where the cable spools horizontally.

Slack Prevention

Because the motor is now mounted horizontally, issues may arise when the cable comes loose inside of the platform due to gravity acting in a different direction than the spooling and tension force.

For example, suppose that when the user is performing an exercise, the user accelerates when in the eccentric direction (where the cable is retracting). In this case, the user is moving inwards faster than the motor can take up the slack in the cable, generating slack in the direction towards the platform.

Similarly, when the user is pulling out on the cable and suddenly stops, this may result in an inertial issue in which slack is produced. The inertia of the motor causes the motor to continue to travel before torque regenerating is able to stop the motor and allow it to reverse. During that time frame, a slack condition is created, where there is no tension on the rope, as the motor's inertia is greater than the torque that the motor is producing.

Thus, the above two slack conditions are dependent on the maximum linear speed that can be imparted on the motor, as well as the inertia of the motor.

When the motor is mounted horizontally, and a slack condition occurs, the cable will droop and fall, causing the rope to no longer be in line with the motor (spool), in which case the cable may then potentially become tangled. For example, when the cable droops and the motor takes up the cable, this may cause a large knot to form around the axle.

Figure 4A:
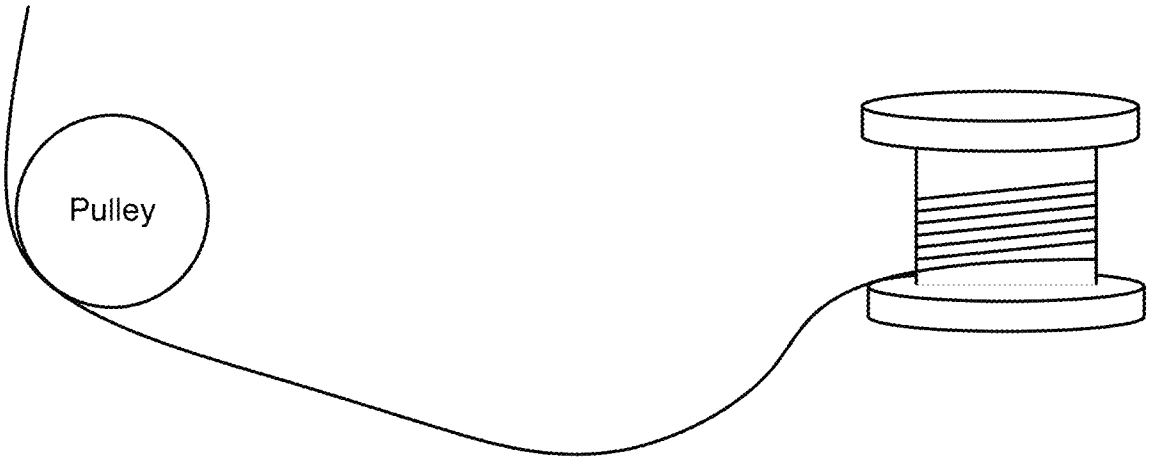
FIG. 4A illustrates an embodiment of a slack condition within a platform exercise machine.

FIG. 4A illustrates an embodiment of a slack condition within a platform exercise machine.

Described below are various embodiments of techniques that may be used to prevent a cable slack condition. For example, cable tensioners and cable guides may be used, examples of which are described below.

Fishing Reel

One example of a tension system is a fishing reel-style system. In some embodiments, the spool/hub includes a part that travels back and forth during the spooling to guide the cable onto the spool in a controlled manner.

Roller on Motor Spool

In some embodiments, a roller on the motor spool is used to keep the rope on the motor. In some embodiments, the roller is attached to the fishing reel-style system described above so that the rope is prevented from bundling up.

Figure 4B:
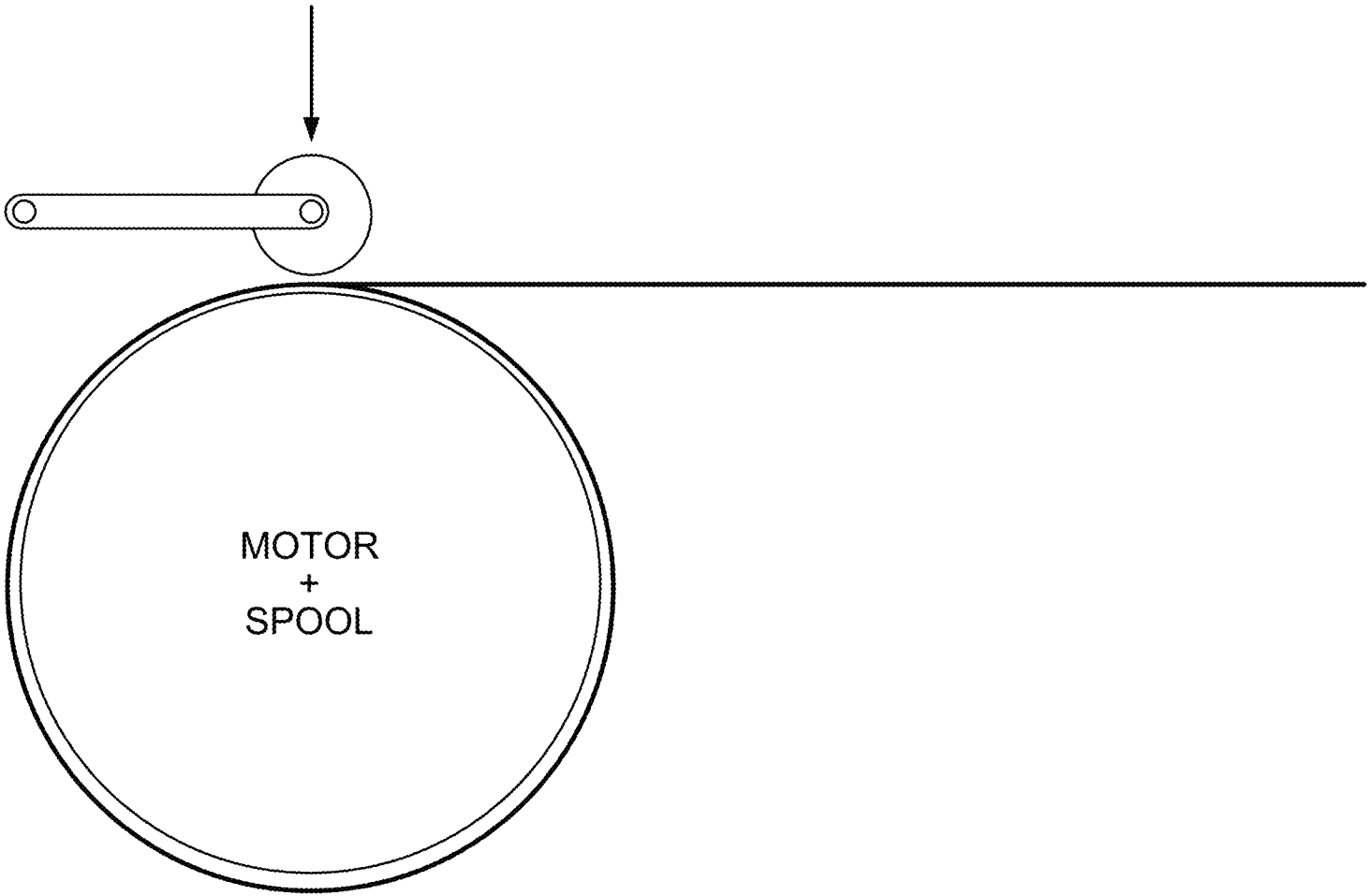
FIG. 4B illustrates an embodiment of a roller on a motor spool.

FIG. 4B illustrates an embodiment of a roller on a motor spool. In some embodiments, with such a system, a variable sized spool may be used (e.g., a two-step spool with different radii for the two different sections of the spool), where the cable may be directed to either the larger or smaller part of the spool depending on whether high speed or high torque is desired.

Guide/Cover

In some embodiments, a guide or cover is placed along the bottom of the platform to prevent the cable from becoming lost, and to ensure that if the cable collects, it is collecting on the spool. In another embodiment, a tube for the cable/rope to travel in is included in the platform. As another example, a cover is placed along the bottom of the spool so that the cable cannot escape. As another example, pulley covers are used to keep the cable on pulleys. The use of a cable tray or guide prevents a cable from becoming knotted up or tossed around inside of the trainer/platform.

Belt Tensioner

In some embodiments, a take-up mechanism is included in the platform. The below example components are usable to provide an internal tension on the cable.

As one example, the platform includes a spring loaded component that is able to change the rope path length such that when there is slack (which increases the rope path length), the spring loaded component takes up the slack. When the rope is under tension, the component attempts to straighten out the rope. One example of such a component is a belt tensioner.

Figure 4C:
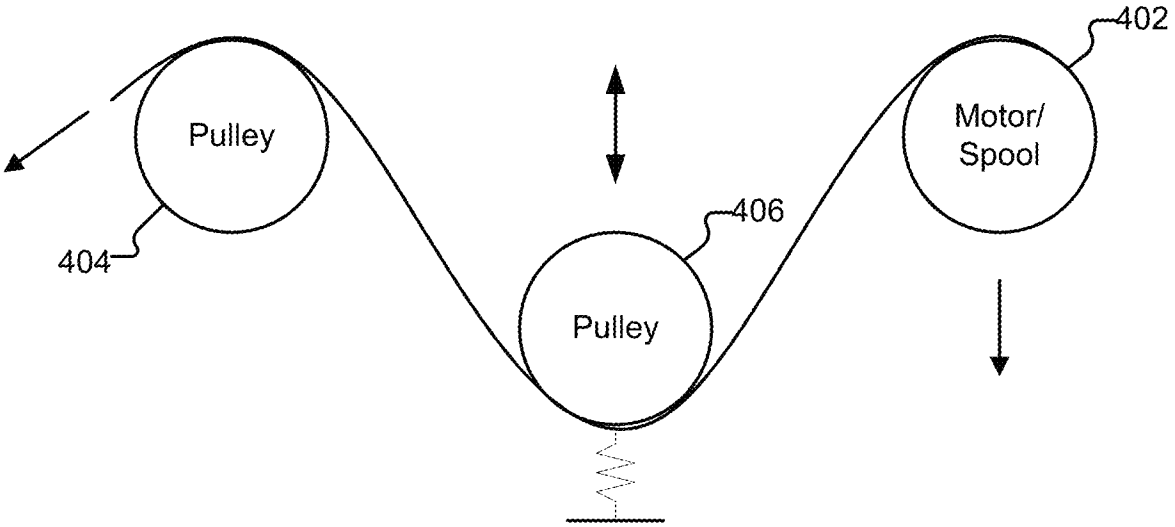
FIG. 4C illustrates an embodiment of a belt tensioner.

FIG. 4C illustrates an embodiment of a belt tensioner. In this example, motor/spool (402) is mounted horizontally within the platform.

In this example, pulley (404) routes the cable out of the exit point/portal of the platform. This pulley directs the cable out of the horizontal plane, and up into the vertical plane (so that the user can pull upward on the cable).

In this example, pulley (406) is an internal pulley to which a spring is attached/connected. The spring can expand and retract, providing tension on the cable and a passive retraction system. This provides an action similar to that of a rotary radial as the rope is pulled in and out, which will change the length of the spring. When a slack event occurs where there is no tension on the rope from the motor, the spring pulls on the pulley 406, increasing the rope path. In this way, a nominal amount of tension in the rope is maintained to ensure that the cable spools on the motor (and does not come off of the motor, which may cause the cable to become tangled).

Another example of a take-up mechanism is a derailleur. Another example of a take-up mechanism is a torsion spring or clock spring on the motor that passively spools the cable. When the system is off, such take-up mechanisms hold tension on the cable. For example, a clock spring or constant-force spring attached to the motor keeps passive tension on the rope/cable, even when power is off.

Using the above mechanisms to prevent slack internal to the platform, any cable slack that does occur will be outside of the platform (and not internally to the platform, where any spooling issues are not accessible to the user). Using the cable guide/cable tensioning mechanisms described above, even if the user does move quickly, creating a slack condition, the slack would occur outside of the platform, and not within the platform. This allows the use of a horizontal motor that is not affected by the occurrence of slack conditions.

In some embodiments, the minimum speed of the motor is made to be fast enough to keep up with spooling of the cable. While there may be a tradeoff with lower speeds, the higher speed minimum allows for more tolerance and acceptance of cable slack.

By using a horizontally mounted motor as described above, along with the cable tension and guide mechanisms described above, a low profile platform may be designed that allows for flexibility in the motor sizes that can be chosen, from low torque/high speed motors, to high torque/low speed motors. For example, small and large size motors may be used to provide different torque/speed tradeoffs, without compromising the height of the platform.

In some embodiments, when the motor is mounted horizontally, a pulley such as pulley 404 is mounted orthogonally to the motor so that the cable may exit out of the top surface of the platform. In an alternative embodiment of mounting a motor in a horizontal plane and having a separate pulley that performs 90 degree translation (so that the cable can be vertically pulled out of the platform), a gearshaft may be put on the end of the motor that is 90 degrees, where a spooling system is then created off of the gear that translates the motion of the motor by 90 degrees. In this way, the motor rotates horizontally, but causes the cable to spool vertically. For example, the motor spins in one direction, with a gear shaft coming off of the motor in another direction, allowing for vertical spooling. The vertical spool may be placed directly under a cable exit point. Examples of such translation mechanisms include worm gears and bevel gears.

Cable Guiding and Exiting

One example challenge with platform-based exercise machines that use cables is rope travel and angle. For example, suppose that a user is standing on the platform performing a squat. When performing the squat, the user needs to ensure that the cables they are pulling from the platform are not angled, while still allowing the user to be firmly planted on the platform (to avoid off balance issues, for example). In some embodiments, to address such issues, the cables or ropes adjust to the user. For example, the bottom of the rope is allowed to track back and forth so that when a user does a movement, the cable will line up and be straight. This prevents awkward angles when performing exercises, and a user does not need to adjust their position and can stay firmly planted on the platform so that the platform remains steady and static. In some embodiments, the platform digital strength trainer includes travelers that allow the cables to track back and forth.

Figure 5A:
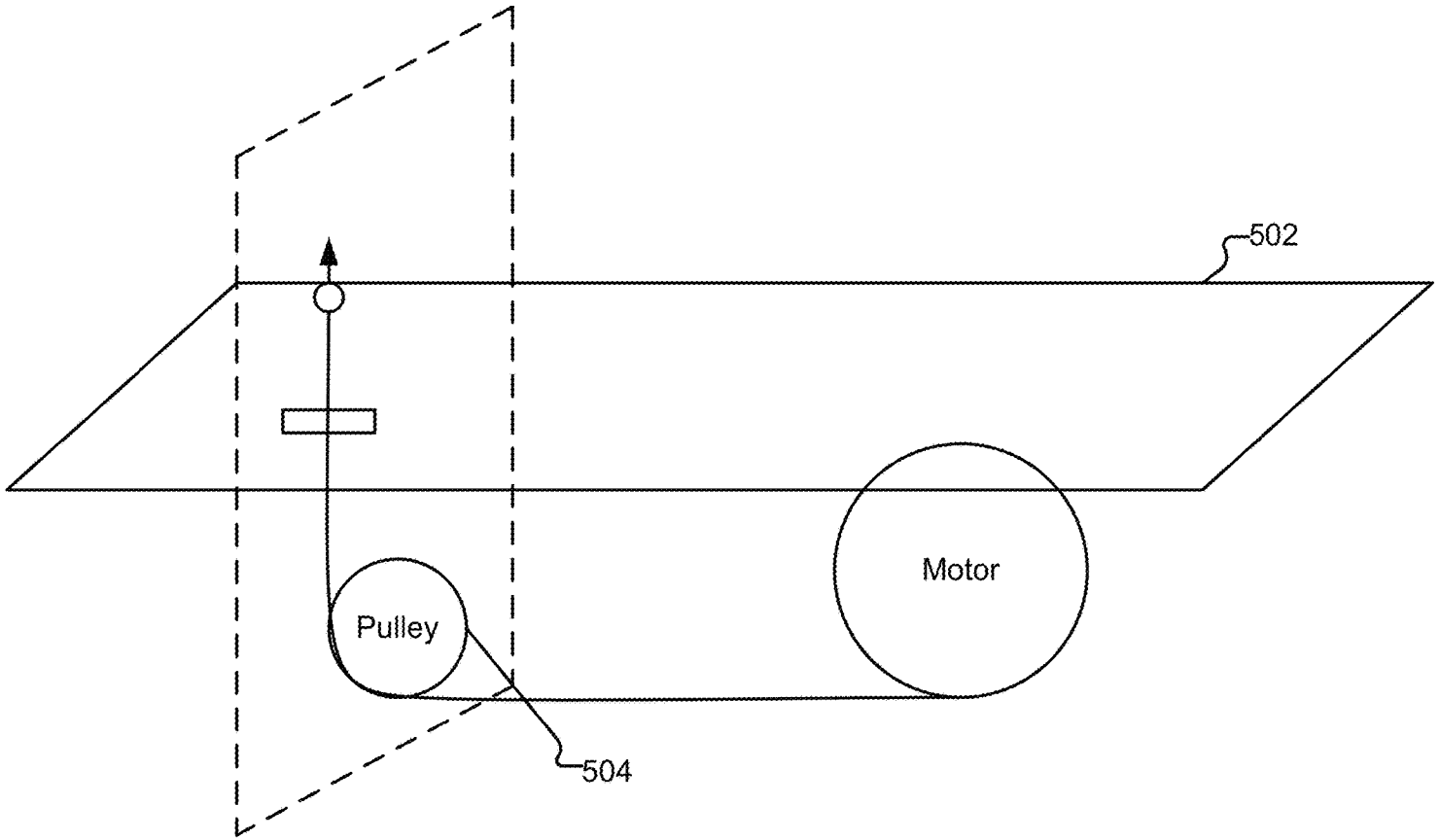
FIG. 5A illustrates an embodiment of guiding a cable out of a platform strength trainer.

The following are embodiments of guiding a cable out of a platform. FIG. 5A illustrates an embodiment of guiding a cable out of a platform strength trainer. Referring to the example of FIG. 5A, a portion of a top surface of the platform (the portion that a user stands on) is shown at (502). Here, the cable is routed form the motor (vertically mounted in this example) and routed around another pulley, where the cable then comes out of the platform. In some embodiments, the platform includes a cable guide so that when the user wishes to pull in a direction in or out of the plane (e.g., the vertical plane), the rope is guided in the desired direction without hopping off or coming off of pulley (504).

Using the guides described herein, the cables can be pulled at any angle (and not only straight up), in such a way that the cable does not come off the pulley. The guides described herein constrain the rope when it is pulled at an angle so that the cable does not hop off of the pulley. Further, the cable exit guides described herein minimize friction as compared to existing techniques. Thus, the cable guiding mechanisms described herein allow pulls in multiple directions.

Rotating Pulley

Figure 5B:
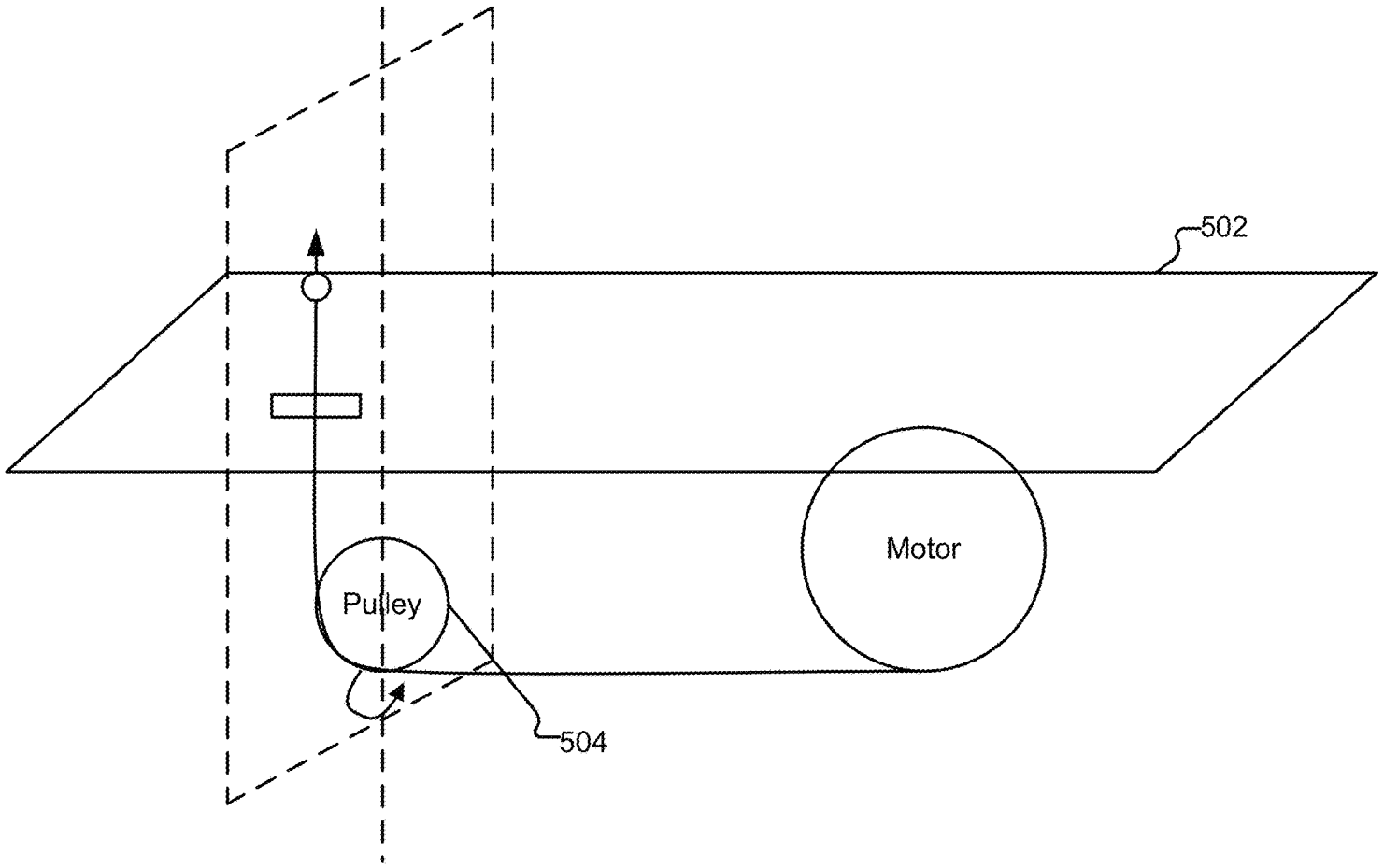
FIG. 5B illustrates an embodiment of a rotating pulley.

As one example, a degree of freedom is added to the pulley (504) of the platform shown in the example of FIG. 5A. FIG. 5B illustrates an embodiment of a rotating pulley. For example, the pulley is designed to rotate about an axis, and swing in and out of the vertical plane with the movement of the cable. In some embodiments, with a vertically mounted motor, the entire motor itself is able to pivot, where the cable comes straight out from the motor (without the need for pulley 504).

Lateral Slot

Figure 5C:
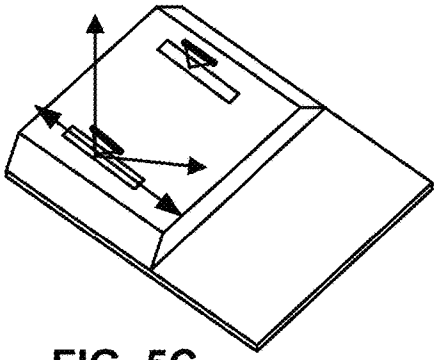
FIG. 5C illustrates an embodiment of a platform with a lateral slot for cable guiding.
Figure 5D:
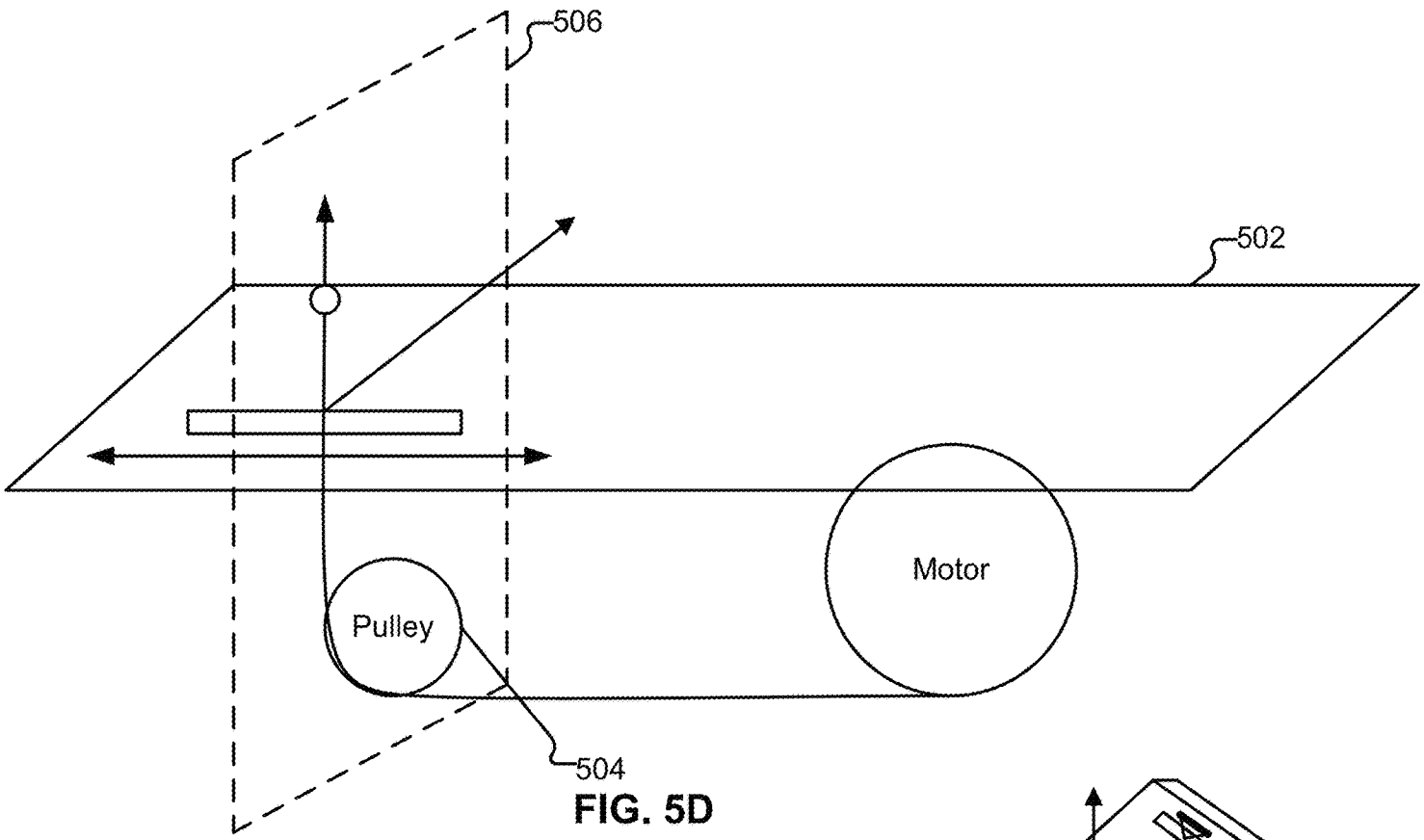
FIG. 5D illustrates an internal side profile view of a platform with a lateral slot.

As another example, the top surface of the platform includes a long slot to allow traveling of the cable to follow the user as they move about. FIG. 5C illustrates an embodiment of a platform with a lateral slot for cable guiding. FIG. 5D illustrates an internal side profile view of a platform with a lateral slot. As shown in the example of FIG. 5D, the pulley (504) travels along a traveler. When a user is coming in and out of the plane (506), the pulley (and cable) moves laterally in the slot, such that the rope does not need to angle as much, but can remain more vertical. This is beneficial for exercises where the user is generally pulling upwards.

Rotating Wrist

Figure 5F:
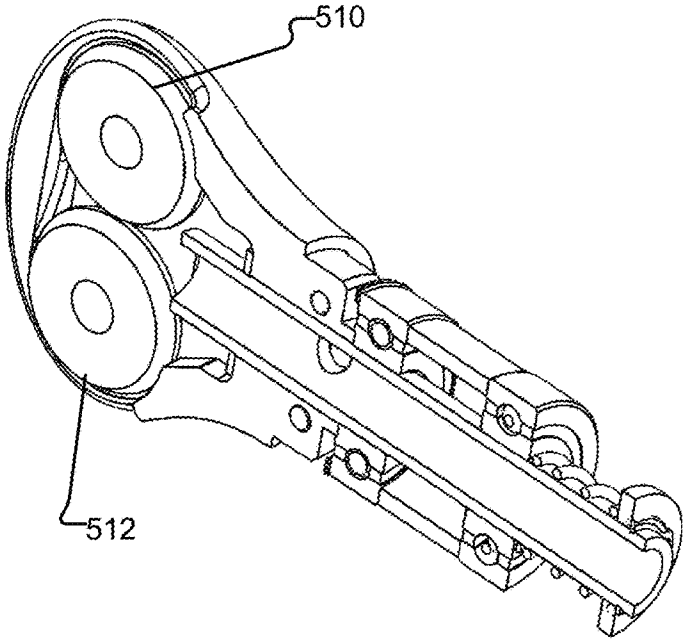
FIG. 5F illustrates an embodiment of a perspective section of a wrist.
Figure 5E:
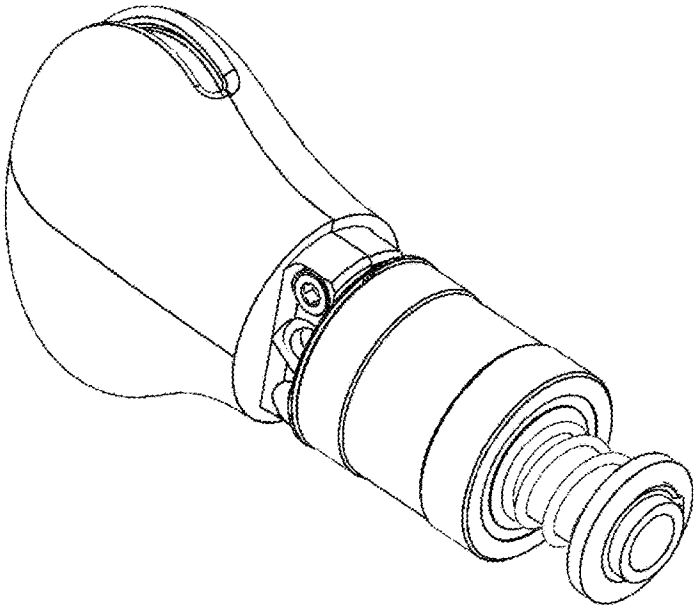
FIG. 5E illustrates an embodiment of a perspective view of a wrist.
Figure 5G:
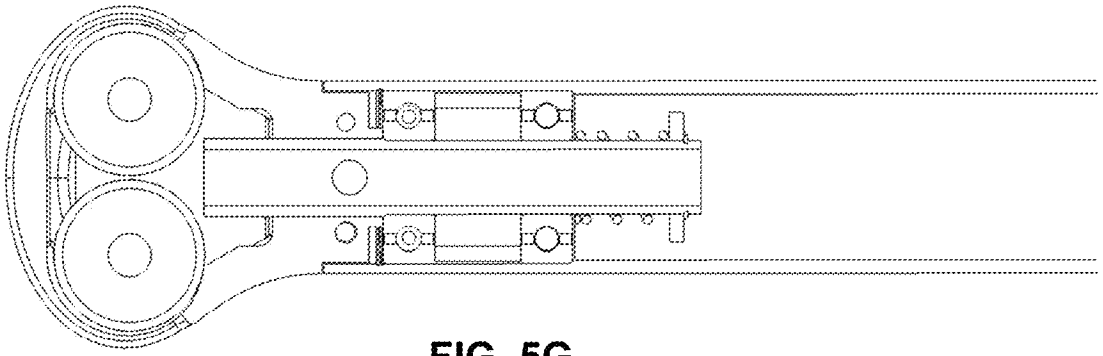
FIG. 5G illustrates a side view section of a wrist.

In one embodiment, the user origination point is a configurable "wrist" to allow local rotation for guiding the cable. FIG. 5E illustrates an embodiment of a perspective view of a wrist, showing a spring mechanism that facilitates access to the interior of the wrist (for example, to the bolts shown in FIGS. 5F and 5G) in order to, for example, service the wrist. This has the benefit of concealing aspects of the wrist without preventing access to them. FIG. 5F illustrates an embodiment of a perspective section of a wrist. FIG. 5G illustrates a side view section of a wrist. As shown in the example of FIG. 5F, the wrist includes pulley sheaves 510 and 512 that are used to guide a cable.

Figure 5H:
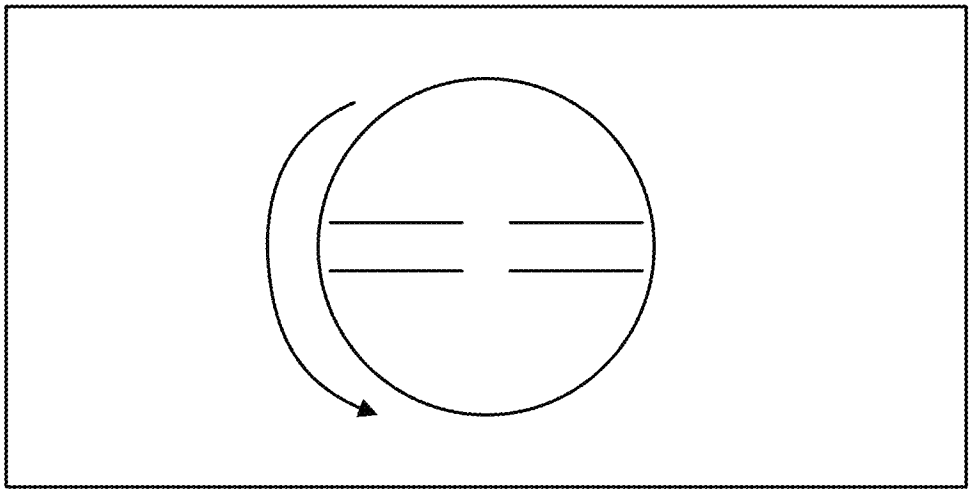
FIG. 5H illustrates an embodiment of a top-down view of a portion of a top of a platform.

FIG. 5H illustrates an embodiment of a top-down view of a portion of a top of a platform. In this example, a round cable exit point/portal is shown. A top-down view of a portion of a cable guiding wrist (e.g., an instance of the wrist shown in FIGS. 5E-5G) including two pulley sheaves is shown in this example. In this example, the opening is rotatable and can spin. For example, the wrist is able to spin in the horizontal plane.

By being able to spin, the user will always be pulling against a pulley (one of the pulley sheaves in the wrist), regardless of the angle of the cable. For example, when the user begins to pull the cable off center (and is not pulling vertically upward, where there is a horizontal vector to their pulling of the cable), this movement causes the wrist to rotate and self-correct such that the cable is always directly pulling on a wrist pulley. This minimizes the amount of friction added when the user is pulling at any angle.

In the examples of FIGS. 5E-5H, the wrist includes two pulleys. In other embodiments, the wrist includes more than two pulleys, such as four pulleys. The number of pulleys determines the amount of rotation of the wrist needed before the cable is pulling on a wrist pulley. That is, the wrist is able to self-correct more quickly with more pulleys. For example, with two pulleys, there is a 180 degree plane that the rotating wrist rotates through. In the example of four pulleys arranged in a star pattern, there is only 90 degrees through which the rotating wrist system spins.

The opening/wrist may be flush or nearly flush. The wrist may also be sub-flush. Having the rotating wrist flush with the top of the platform prevents users from tripping on the wrists.

The above techniques for guiding cables are in contrast to existing mechanisms such as overlapping rollers that are used to guide a cable in any direction coming out of a platform. One downside of such existing rollers is that they generate a large amount of friction.

The large amount of friction generated with existing guiding techniques presents various issues with respect to digital weight training. For example, it would be beneficial if the user is provided an exact tension that is controllable via the motors. When friction is introduced, such friction opposes user movement. This results in swings in the amount of tension experienced by the user, reducing the accuracy of the digital weight/tension.

The above cable guide implementations, such as the rotating wrist, reduce friction, allowing for more accurate digital weights. In another embodiment, rollers may be used to guide the cable, where, in order to reduce the friction added by the use of rollers, the rollers are adapted by mounting them on a rotating system, introducing another degree of movement.

By reducing friction, the cable guiding techniques described herein minimize the wear and tear on the cable as well, extending the life of the rope. Further, users are not constrained to performing exercises in which the cable only moves vertically in and out of the platform, and may have the cable angled. For example, if the pull point is not movable, it is unlikely that users will always be pulling the cables straight up and down. There will be vectors to the way they are pulling. The techniques described herein minimize the additional friction when users are performing moves and the cables are angled.

Pull Point Traveling

Figure 6A:
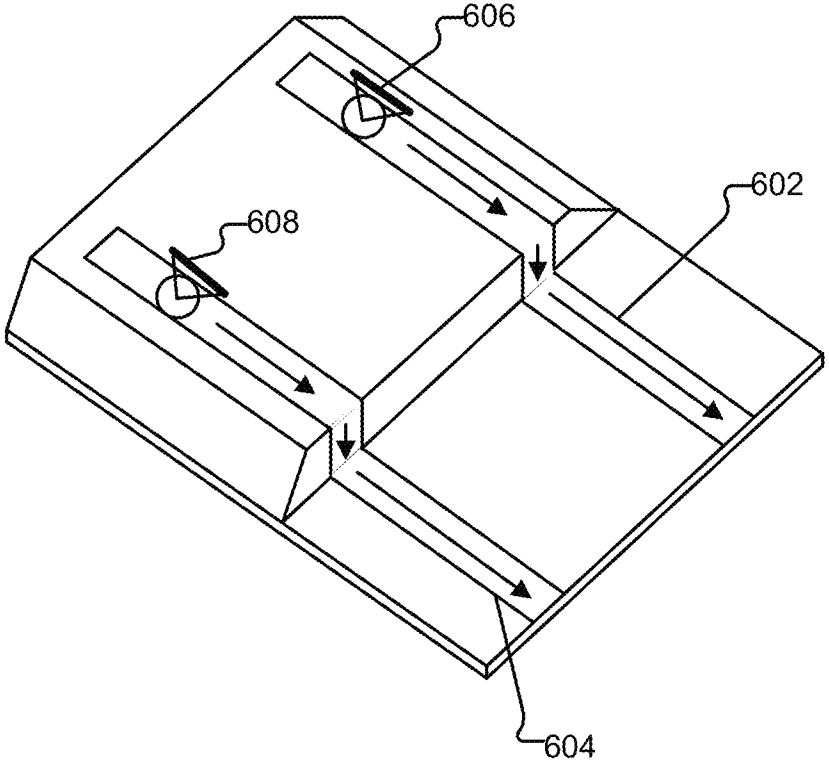
FIG. 6A illustrates an embodiment of a platform exercise machine with tracks.

In some embodiments, the pivot points of the pulleys are adjustable and movable. For example, the pulleys may be moved to different locations on the platform FIG. 6A illustrates an embodiment of a platform exercise machine with tracks. In the example of FIG. 6A, the platform includes tracks 602 and 604 to allow the pulleys/cable exit points (606 and 608, respectively) to be moved to different locations for performing different movements.

As shown in this example, the platform includes motors and electronics at one end, where the pulley points may be moved to various locations along the platform and/or plate to accommodate various types of movements. This provides greater flexibility in the range of exercises that a user may perform. For example, the rotating wrist style mechanism described above may be moved along a track.

As shown in this example, the pull points may also be made to exit from the front face of the bulge or pedestal/raised portion of the platform. This allows performing exercises such as seated rows, as will be described in further detail below.

In some embodiments, the pull point or anchor point may free float along the track. For example, the wrist may follow the user as they move along the platform while holding the cable. In some embodiments, the pull point may be clipped or held or locked down to predefined fixed points as the user translates the pull point along a track.

Figure 6B:
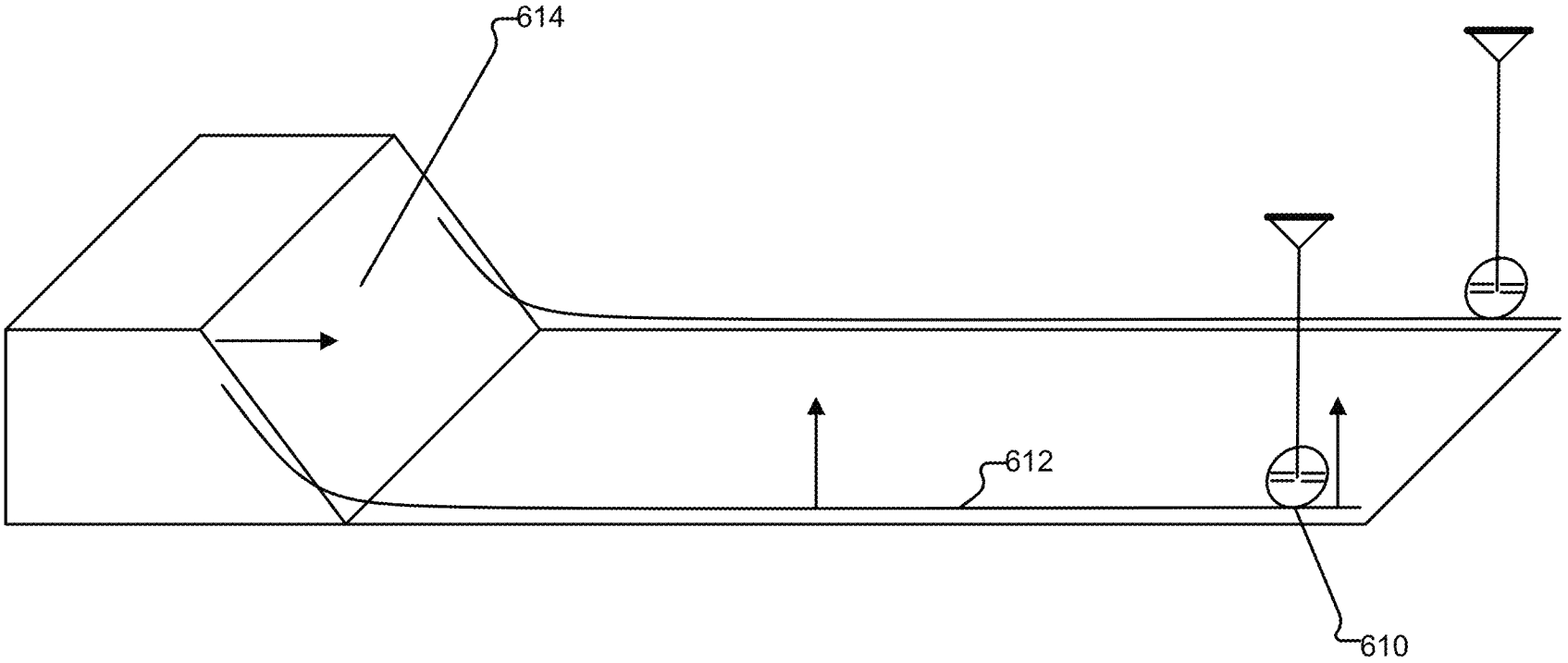
FIG. 6B illustrates an embodiment of a platform with movable pull points.

FIG. 6B illustrates an embodiment of a platform with movable pull points. In this example, a platform with a larger, thinner plate is shown. In this example, a pull point such as pull point is 610 is implemented, for example, using a wrist as described above. In this example, the pull point is able to be slid up and down along the edge of the platform on a track such as track 612. As described above, the pull point may free float or clip down to different points as the user translates the cable. As shown in this example, the cable may also exit out of the front face of the "bulge" (614) or platform housing where components such as motors and electronics may be located. In some embodiments, the track may extend to the top of the "bulge," as shown in the example of FIG. 6A, so that the cable may be routed over auxiliary mounts, as will be described in further detail below.

Force Multiplier

In some embodiments, the floor-based digital exercise machines may be used in conjunction with what is referred to herein as a "force enhancer" in order to adjust mechanical advantage. For example, using the same motor with the same power, twice the tension can be generated by introducing an additional pulley or pick up point. In this case, the action is slower, where tension is traded for speed. In some embodiments, the pulley is implemented via a pickup point. In some embodiments, the platform exerciser includes two pick-up points, one for single force, and one for double force, using the same cable.

Figure 7A:
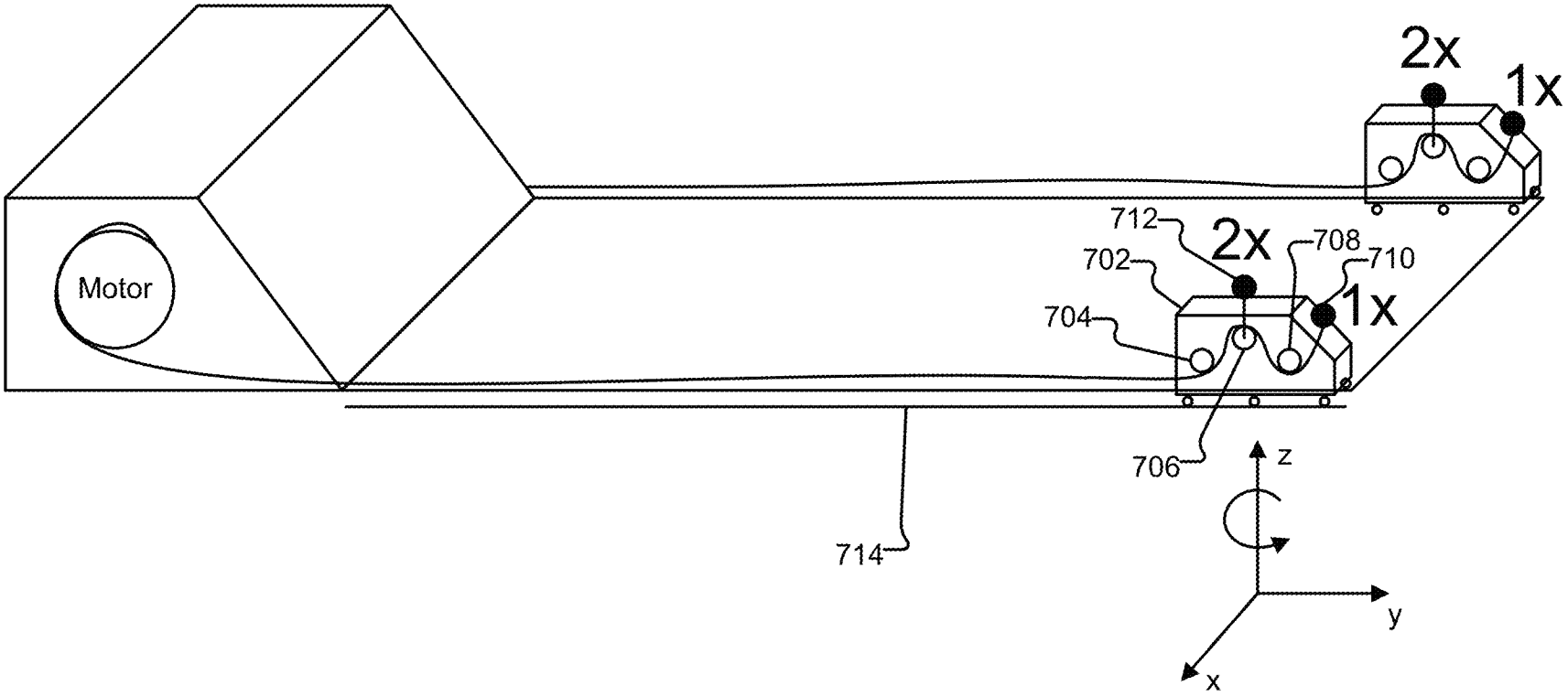
FIG. 7A illustrates an embodiment of a platform implementation in which a force multiplier is provided.

FIG. 7A illustrates an embodiment of a platform implementation in which a force multiplier is provided. In this example, double the tension may be provided to the user.

In this example, a carriage or cart 702 includes a set of pulleys (704, 706, and 708) as well as two pull points 710 and 712 from which an actuator such as a handle may be attached.

In some embodiments, in order to prevent the cable from retracting back into the platform, an exercise machine connector including a cable connection base, stop, or in some embodiments, a "ball stop" is attached to the user's end of the cable. The connector may be substantially spherical in shape, such as a ball or flexible ball. This cable connection base may be used to include safe and secure attachment points for connecting to user actuators such as a carabiner, strap, handle, bar, dual handles, pull-down bar, and or rope to perform various exercises. The ball stop allows convenient detachment of actuators from the cable connection base. The cable connection base is easy and/or efficient for a user to attach and detach actuators, yet safe to prevent sudden release.

As shown in this example, there are two ball stops (710 and 712) to which the user can connect an actuator. Further details regarding ball stops are described below.

In one embodiment, the detachable coupling of the attachment point may operate where the ball extrudes a male flat rigid piece with a hole in it. This piece snaps into a spring-loaded connector that is attached to the actuator, for example, a handle or bar. The hole traps the connector with a snap and this connection acts as a lock. To unlock the connector from the ball, the user may push down the button on the connector to disengage the end snap and to allow the rigid piece to disengage from the connector. The hole in the male flat rigid piece also may serve as an attachment point for a carabiner to allow a non-compatible handle to be used.

In one embodiment, the detachable coupling of the attachment to the cable connection base is achieved by a spring-loaded mechanism in the cable connection base that receives a male T-shaped portion of an actuator connector. The T-shaped portion snaps into the cable connection base and an actuator such as a handle or bar is attached to the actuator connector. The mechanism traps the connector with a snap and this connection acts as a lock. To unlock the connector from the cable connection base, the user may push the connector and rotate the connector against the mechanism.

In some embodiments, the detachable coupling of the attachment point may operate in a lock and key configuration, where the attachment point on the actuator, or key, includes an extended and/or cylindrical linkage/bar that is inserted into a chamber adapted to receive a key through an opening of the chamber, groove, or keyhole of the cable connection base body. The chamber may be open on one or more sides. The key may be received via a slot. In a preferred embodiment, the key is a T-shaped linkage/bar that permits a degree of freedom in one dimension to swivel around the top member of the "T" of the T-shaped linkage/bar. In another embodiment, the key is an extended X-shaped linkage/bar when degrees of freedom are minimized.

The chamber adapted to receive the key may be part of a cage structure and/or a rigid cage that resides within the body of the cable connection base and includes a biasing mechanism within the chamber, such as a spring or set of springs. In one embodiment, a cap plate covers the key-side of the spring to protect the spring from being entangled. In another embodiment, no cap plate is required to simplify the mechanism. The key may be locked in place by pushing down against the biasing mechanism and then rotating the key, for example by 90 degrees. The connector has a receiving groove within the chamber wherein the biasing mechanism biases the key against the receiving groove so that the key is securely fixed within the chamber. For example, after the key is rotated, the biasing mechanism, for example, through elasticity of a spring, may retain the key in place by pushing the key against a stop such as a recess, preventing it from disengaging unless it is pushed down and rotated back in the opposite direction. An actuator may be coupled to the cable connection base to operate components on the arm or exercise machine.

An exercise machine connector with lock and key configuration is an example of an exercise machine component that permits the attachment of various actuators such as a carabiner and a strap, dual handles, single handle, pull-down bar, and so forth, in order to perform various cable-based exercises.

In this example, each pull point is associated with a corresponding ball end or ball stop to which a handle may be attached (e.g., via a T-lock mechanism as described above). In this example, one ball stop (710) is for single force (1× tension), and the other ball stop (712) is for double force (double tension). In some embodiments, the cart travels along the track (714). The other side of the platform/plate may also have a duplicate track for a single handle.

In some embodiments, the entire cart is rotatable about the Z-axis. This allows for the cable guiding described above. In some embodiments, the position of the cart is lockable along various points along the track. Once locked, the cart is prevented from retracting in and moving backwards towards the motor (based on the motor spooling action causing the cable to be under tension, which would pull the cart back towards the motor). In other embodiments, the cart is designed such that it is able to travel under tension.

With the cart locked in position, the user is then able to pull on either of the ball ends. In this way, when the user pulls on the 1× ball stop, they receive a 1× load, but when the user pulls on the 2× ball stop, they receive double the load. When the user pulls on the 2× load, the pulley 722 and cables follow along. In some embodiments, when the user pulls on the 2× ball stop, the 1× ball stop prevents the terminal end of the cable from moving.

As shown in this example, a mechanical advantage is adjusted when the user lifts on the 2× ball stop, and the terminal end of the cable is fixed. For example, the terminal end of the cable is fixed from moving into the cart by the 1× ball stop. The terminal end of the cable may be fixed using other mechanisms, such as locking or connecting the ball stop (or any other type of connector at the terminal end of the cable, as appropriate) to another fixed item such as the plate. Here for example, using block and tackle mechanics, actuator force is doubled while actuator velocity is halved. This may correspond to a resistance unit force doubling and/or resistance velocity halving if along the resistance unit's force-velocity curve for a given electrical power to the system including any system losses. In one embodiment, the system accepts a lower maximum velocity or lower maximum force, for example to 300 lb instead of 400 lb, and/or increase electrical power to the overall system. Using other block and tackle configurations and/or pulley configurations, other force and velocity tradeoffs may be established to, for example, increase actuator force by 300% while reducing actuator velocity to 33%. Such a design may give an improvement of greater range of exercises, for example if the exercise machine has a motor limitation with a maximum force of 200 lb, this may not be enough to cover a user who wishes to practice a slow deadlift movement from the plate of 3001*b*.

Figure 12B:
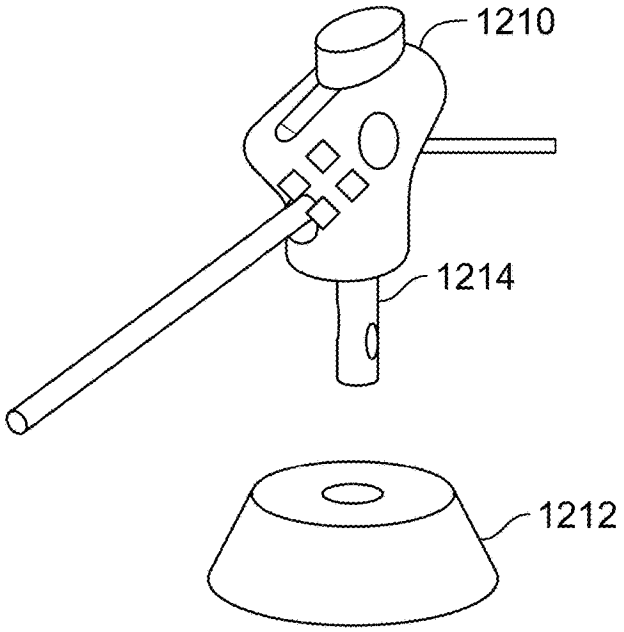
FIGS. 12A and 12B illustrate embodiments of an attachable/detachable wrist for adjusting cable pull points.

In this example, the cart may be translated along a track. In this example, to move the cart to various positions, the user unlocks the cart from one position, where they then slide the cart to the next position and lock the cart in place. In an alternative embodiment, the platform does not include a track. Instead, the platform includes discrete points corresponding to positions in which the cart may be locked (e.g., similar to as shown in the example of FIG. 12B, but with the locking points on the platform, and not only on the wall). For example, to adjust the position of the exertion/pull points, the user may unlock the cart, lift up the cart, place the cart in the next discrete point, and then lock the cart in that point. Having discrete locking points where the user lifts the cart and places it into position allows the user to position the pull points where desired, without requiring a track.

As described above, in some embodiments, the force doubler may be used to allow the user to perform exercises such as squats, where the tension on the cable with the force doubler is double the tension that the motor is capable of applying.

In some embodiments, electronics in the platform are configured to detect which ball stop the user is using when performing their exercise. By knowing which pull point the user is using, the platform strength training system is able to determine weight and inertia, allowing the strength training system to accommodate the determined weight/inertia, as well as report the weight/inertia.

The following are examples of determining which pull point/ball stop (e.g., 1× versus 2×) the user is using. As one example, each of the pull points causes a certain corresponding set of pulleys to rotate. Which pull point is being used is determined based on which of the pulleys are rotating.

As another example, which ball stop is moving may be determined based on measurements from accelerometers in the ball stops.

As another example, the speed of the handles versus the speed of the motor is determined. For example, with the use of the force doubler, there is double the tension, but half of the speed.

The speed of the handles may be determined by measuring the rotational speed of the pulleys. For example, a sensor may be included in the cart to measure the rotational speed of a pulley, where the measurement is provided back to a processor in the platform. For example, the pulley rotational speed measurement may be provided wirelessly via a protocol such as Bluetooth.

As another example, each ball stop may have its own respective cradle that includes a pressure sensor. When the ball stop is used by a user, the load on the pressure sensor is removed, indicating that the corresponding ball stop is in use.

By knowing which pull point the user is using, the platform is able to determine and report the correct weight that the user has resisted.

Figure 7B:
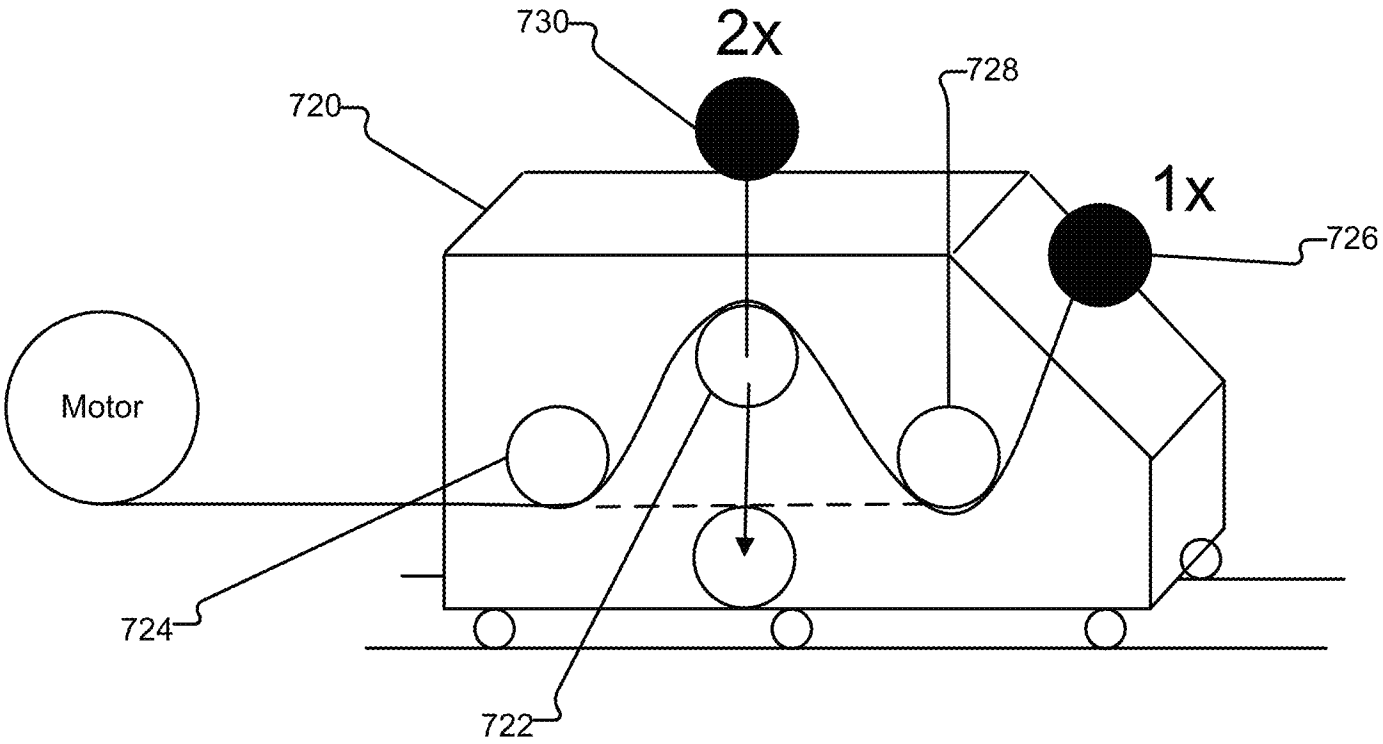
FIG. 7B illustrates an embodiment of a force adjustment module.

FIG. 7B illustrates an embodiment of a force adjustment module. In some embodiments, the force adjustment module (720) shown in FIG. 7B is an example of cart (702) shown in FIG. 7A. In this example, the center pulley (722) translates up and down depending on whether the user is using the force doubler (e.g., the pulley 722 is at the bottom of the cart when the user is not using the 2× ball stop, and is lifted up when the user is pulling on the 2× ball stop). For example, when the user is not using the force doubler, the center pulley drops down to a lower position. In this way, the left pulley 724 and the center pulley 722 are not affecting the system tension or friction when the user is using the 1× pull point 726 (where the cable is effectively going over only the pulley 728 on the right). When using the force doubler (2× ball stop 730), the left pulley 724 and the center pulley 722 are engaged.

Front Facing Pull Point

Figure 8:
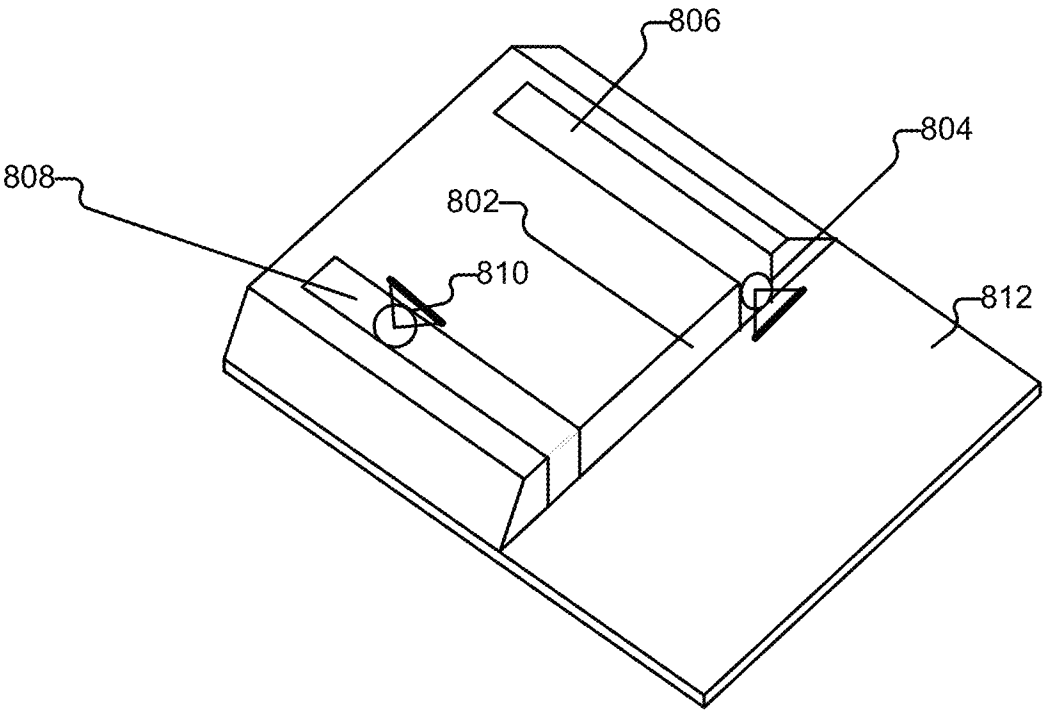
FIG. 8 illustrates an embodiment of a platform including adjustable pull points.

FIG. 8 illustrates an embodiment of a platform including adjustable pull points. In this example, the platform includes two tracks, one for each pull point. The tracks (e.g., tracks 806 and 808) allow the pull points (e.g., pull points 804 and 810) to be translated from the top of the platform to the front (802) of the bulge. In this example, the platform also includes a lower plate portion (812).

Having pull points that are adjustable from the top of the platform to the front face of the platform allows for greater flexibility in the range of exercises that may be performed. For example, exercises such as seated rows may be performed using the front facing pulley points. Lateral movements such as lateral lunges are also supported, where the user has one foot on the platform and is performing a sideways movement. Other types of movements, such as chops and rotating lifts, are more easily performed using the front facing pulley point. Having a front facing pulley point allows for the ability to perform exercises when a user steps down off of the platform. With the top pulley points, users may perform exercises such as squats or deadlifts. Front facing pulley points allow users to perform off-angle movements.

Thus, as shown in this example, the platform has an upper portion and lower portion. The upper portion in this example includes a "bulge" that may house components such as motors/electronics, etc. The lower portion includes a plate on which the user can stand. As described above, travelers may be used to allow the cable pull points to be translated along the tracks, so that the pull points may exit from the top of the upper portion, a front face of the upper portion, or from the lower portion of the platform device.

Pressure Sensors

In some embodiments, the platform includes pressure sensors. The pressure sensors may be used for a variety of purposes. As one example, pressure sensors under the platform may be used to determine weight and body composition of a user if they stand barefoot on the platform, and given a known weight of the platform. Force transfer through the feet may also be determined or sensed using such pressure sensors. As another example, the pressure sensors may also be used for safety, as well as detecting user form, as will be described in further detail below.

Tilt/Lift Prediction

There are various challenges involved with a platform configuration. For example, in a platform that a user stands on, the user's weight is used to keep the platform in place and prevent it from moving. However, if a user is not fully standing on, or is off balance on the platform when performing an exercise such as a lift or other explosive exercise, this can result in the platform moving, resulting in injuries to the user and other safety issues. Described herein are techniques for addressing such challenges by keeping the platform static and preventing it from moving, as well as minimizing instability.

In some embodiments, the platform is capable of being mounted or bolted or otherwise secured to prevent movement. For example, the platform may be bolted into the floor or the bottom of a wall.

In some embodiments, where the floor-based device is floating (and where the device stays in place based on the user's weight being on top of the device), the device includes a set of pressure sensors that detect the presence or absence of weight on the top of the device. If the pressure sensor detects a loss of weight on the device (e.g., due to a user stepping off of the platform), the torque provided by the motors (e.g., that is pulling the cables in and is used to resist the user pulling the cables out) is cut (e.g., in half). This enhances the safety of the device. As another example, the device includes a component such as an accelerometer to detect tipping or lifting. In response to detecting such movement of the platform, the torque on the motor(s) is also cut.

In some embodiments, the platform uses various sensor measurements to detect or anticipate or predict whether the platform will lift off of the ground. Actions may then be taken to prevent the platform from lifting or tilting. This includes controlling the internal motors of the platform to turn off the digital weight, reduce the weight, etc.

As one example, accelerometers and/or gyroscopes may be used to detect tilting of a platform. As another example, a distance sensor such as an optical sensor (or a set of optical sensors, such as four optical sensors) may be used to measure the distance between the platform and the floor. If tilting of the platform is detected, then the weight/resistance provided by the motor is reduced (e.g., either progressively reduced or disengaged entirely).

Examples of sensors that may be used to predict platform lifting include pressure sensors, distance sensors, and tilt sensors. One example of a pressure sensor is a weight gauge or strain gauge.

In some embodiments, pressure sensors (or strain gauges), or force sensing resistors, or spring loaded feet are used by the platform to determine the amount of force into the floor. If the platform determines that the amount of force into the floor is below a threshold, then in some embodiments, the motors are controlled to progressively unload digital weight or disengage entirely.

In some embodiments, inertial models are used to improve pressure sensing. When a user is only partially on the platform (and is not fully standing off of it) and moves fast, they may cause the platform to lift. Pressure sensors may also be used to sense whether the person is standing on the platform, as described above. In some embodiments, an inertial model of the motors of the platform is used to determine the amount of time that the platform will be lifted upwards by a higher load. In some embodiments, inertial correction may be performed to anticipate lifting of the platform. In some embodiments, the inertial models are built to ensure that rapid user movements do not exceed downward force that could cause the platform to lift briefly and bump up/down.

In some embodiments, based on the detected speed of the cable (e.g., when the user is pulling on the cable), the weight of the platform, and inertia of the motor (determined based on the inertial model, which indicates the amount of time for the motor to adjust its force), the platform predicts when the platform would actually lift. In response to predicting that the platform will lift, the platform may take various actions, such as reducing torque/load to prevent lifting (e.g., by transmitting a signal to the motor controller to reduce the torque of the motors).

In this way, the platform is able to counteract for the inertial portion of where the platform potentially lifts off of the floor by reducing force or torque of the motor for an amount of time. In this way, preventative actions may be taken by the platform before the platform lifts.

Here, using the lift anticipation techniques described herein, the force provided by the motor is reduced ahead of time so that the platform does not lift and then crashes back down.

Further, using the lift anticipation and prevention techniques described herein, more force may be provided to the user during regular operation, as a ceiling on the maximum force that can be provided to a user need not be established to prevent lifting. Thus, instability may be anticipated and preemptive actions may be taken to prevent or reduce instability.

As will be described in further detail below, the cables of the platform may be coupled to auxiliary pulleys (e.g., high pulleys mounted on a wall or door frame). In some embodiments, in cases where such high pulleys are used, but the platform is not mounted to the floor or wall, and users are performing moves such as lat pull downs (where the user is on the platform) or rotational chops (where the user is likely not to be on the platform, or may have only one foot on the platform), pressure sensing is used to limit the maximum tension the user can request from the platform (where the motor controller limits the amount of torque that may be generated by the motors). This reduces the potential for lifting of the platform.

Form Feedback

In addition to determining a weight of a user, pressure sensors may also be used to determine form feedback. For example, the distribution of the user's weight on the platform may be determined. The platform may determine whether the user's weight is evenly distributed from left to right and/or front to back. For example, a pressure sensing matrix on the surface of the platform may provide form feedback on left/right user balance and what parts of the feet are being loaded. In this way, the user's form is sensed based on where their weight is distributed on their feet.

Auxiliary Pulleys

Described above are embodiments of digital exercise machines and digital strength trainers where load elements such as motors are lower or closer to the floor. In the above example configurations, users pull cables upward or outward from a platform or other floor-based device. Described herein are techniques for facilitating pull-down exercises involving a platform or other floor-based exercise machine configuration (e.g., bench, as will be described in further detail below).

In some embodiments, increased versatility is provided via a decoupled exercise system. For example, the ability to perform downward pulling moves is implemented via the decoupled system. Examples of such decoupled exercise machine configurations include motorized devices that are down low where the cables come from (e.g., the platform digital strength trainers described herein), and one or more secondary or auxiliary pulley points up higher for allowing exercises such as pull-down exercises.

As one example, pulleys are provided that may be set high. For example, the pulleys are wall mounted. The cables from a platform or bench or other floor device may then be wrapped around the wall mounted pulleys, allowing the user to perform pull-down exercises. That is, in some embodiments, there is an interface with a mounted component such as an auxiliary pulley or other mechanism to allow the user to perform a pulling movement from above.

In some embodiments, the cables of the platform may be coupled to auxiliary pulleys external to the platform. For example, auxiliary pulleys may be mounted high up on a wall. The cables of the platform may then be extended to wrap over the auxiliary pulleys, allowing the user to perform pull down exercise movements. By being able to couple a platform to wall mounted auxiliary pulleys, pull-down exercises may be performed.

Examples of exercise machine configurations in which floor-based digital strength trainers are coupled to auxiliary pulleys are described in further detail below.

Platform with Low and High Pulleys

Figure 9A:
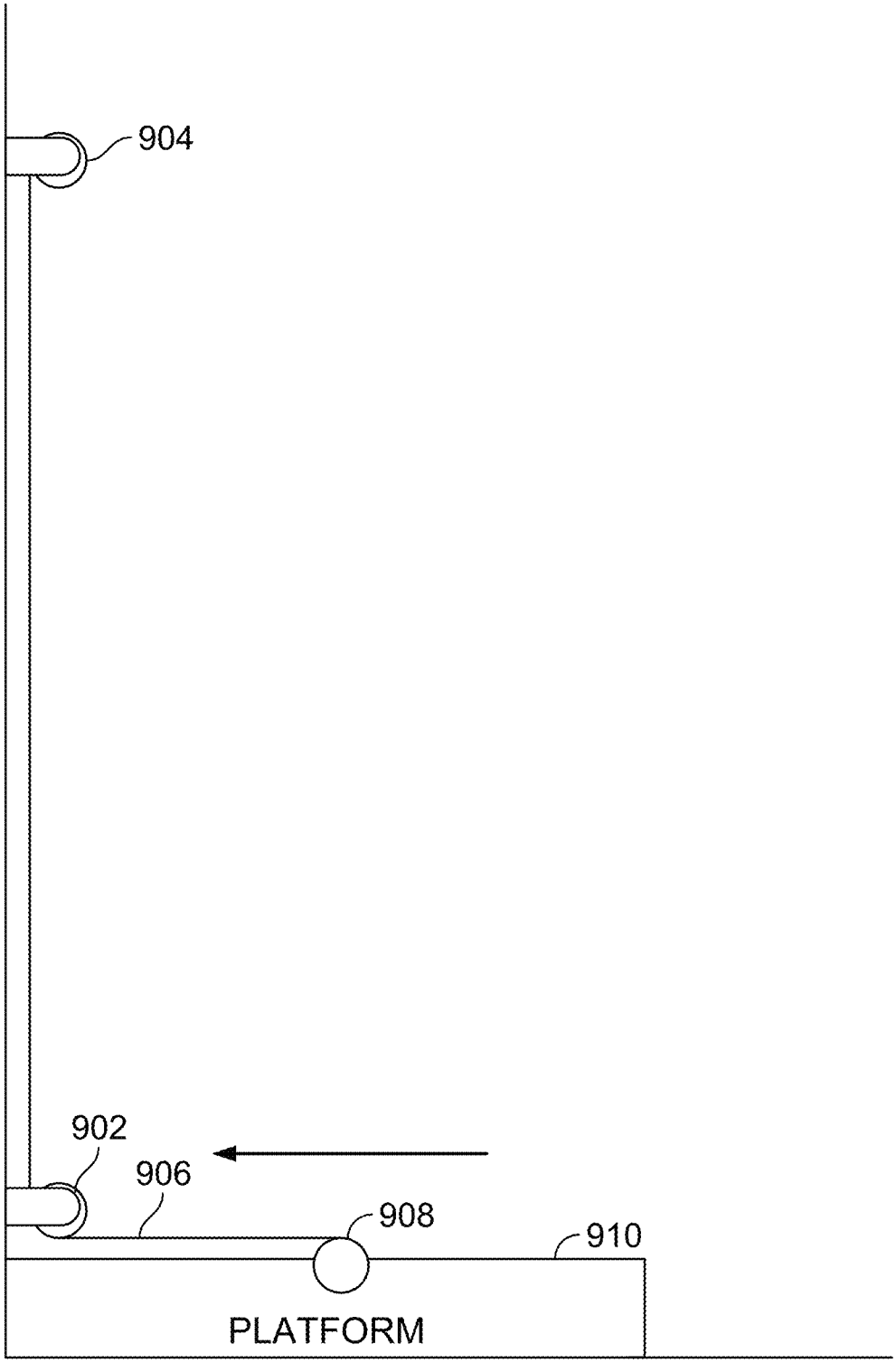
FIG. 9A illustrates an embodiment of an exercise system including a platform and a set of auxiliary pulleys.

FIG. 9A illustrates an embodiment of an exercise system including a platform and a set of auxiliary pulleys. In this example, a set of auxiliary low pulleys (902) and a set of auxiliary high pulleys (904) are shown. In the example of FIG. 9A, a side profile is shown, and the low pulleys/high pulleys are replicated on the other side of the platform.

As shown in this example, a cable 906 exiting from portal 908 of platform 910 may be routed about pulleys 902 and 904, allowing the actuator to hang down from upper pulley 904. Various mechanisms by which a cable may be wrapped about an auxiliary pulley are described below. In some embodiments, the use of the low pulleys prevents the platform from being lifted up when the user is pulling down on the cables from above. Here, the use of the low pulleys translates the pull down force of the user (when pulling down on handles from pulley 904) from a vertical force on the platform into a horizontal force towards, for example, a wall. That is, the platform will primarily be pulled into the wall, rather than being lifted. In this way, the platform need not be mounted to the wall. Further, as the platform need not be wall mounted, the platform may be moved around to perform various types of exercises.

Figure 9B:
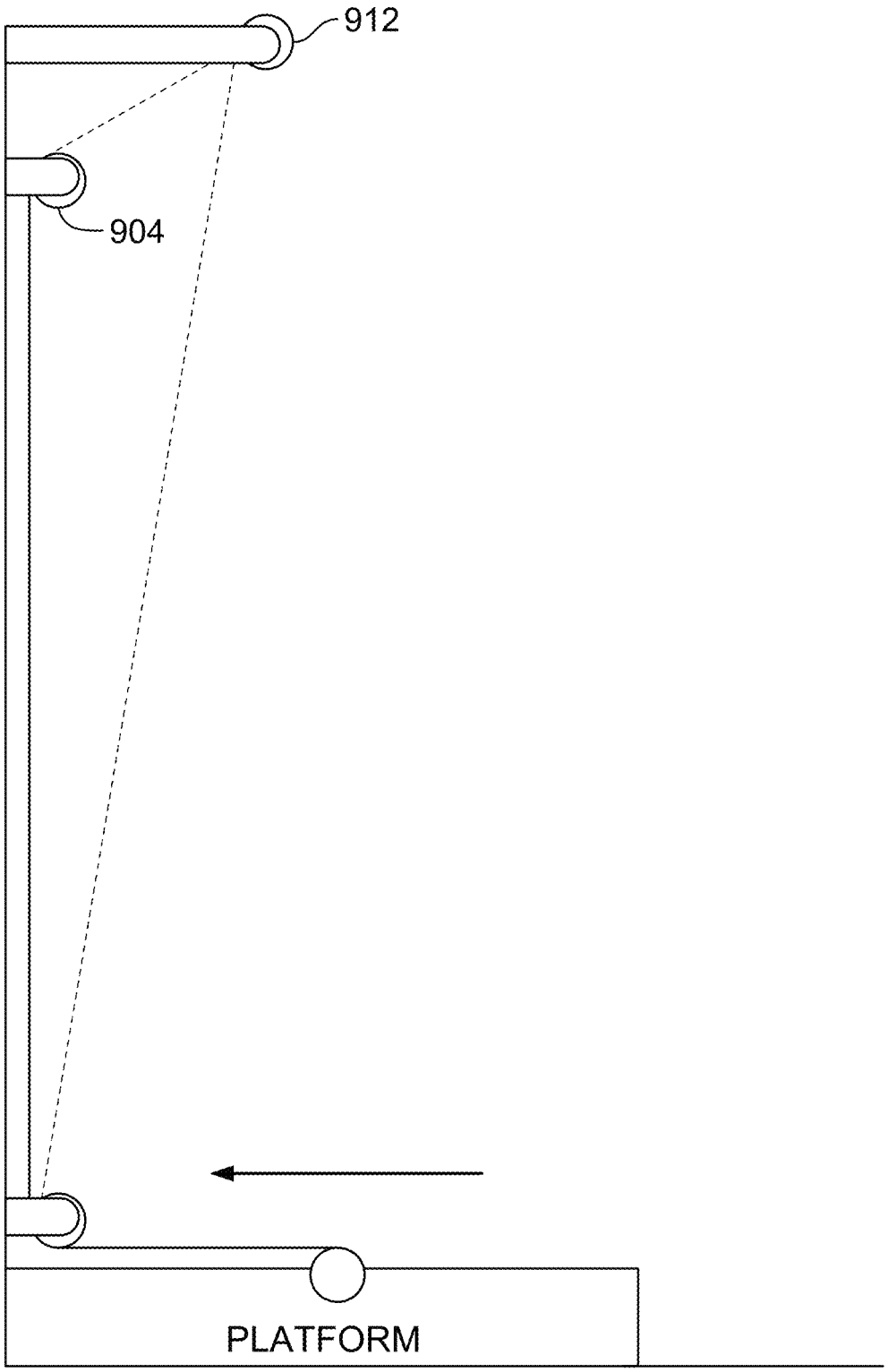
FIG. 9B illustrates an embodiment of an exercise system including a pull up mode.

FIG. 9B illustrates an embodiment of an exercise system including a pull up mode. In this example, the auxiliary pulley is implemented as part of a pull-up mode. The cable from the platform may either be routed through pulley (904) and then on to the pulley on a pull up bar 912, or the cable may be directly routed about the pulley on the pull up bar 912.

Example Auxiliary Pulley Implementations

The following are various embodiments of auxiliary pulley designs that allow a cable from a platform to be routed over the auxiliary pulley. In some embodiments, the pulleys are wall mountable.

Carabiner with Pulley

Figure 10:
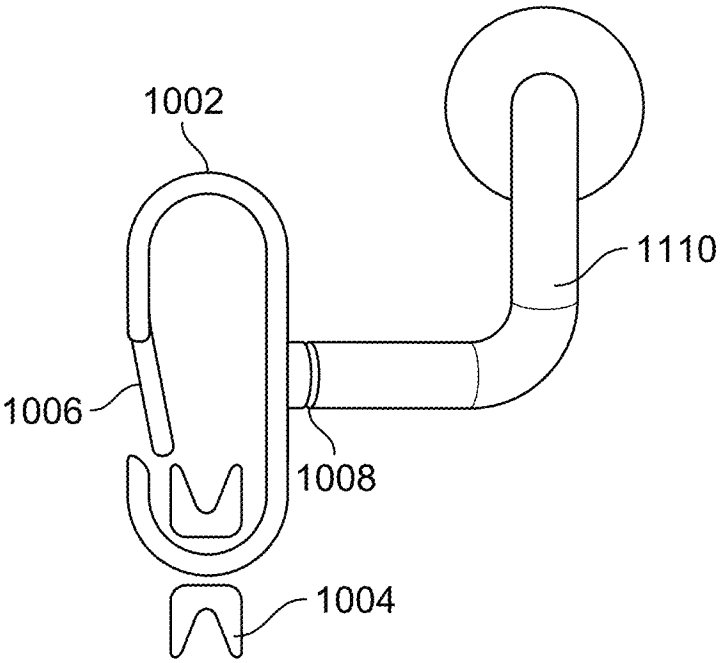
FIG. 10 illustrates an embodiment of a carabiner-pulley type mechanism.

FIG. 10 illustrates an embodiment of a carabiner-pulley type mechanism. As shown in this example, a pulley 1004 is combined with a carabiner-type mechanism 1002 that allows the user to clip the cable from the outside, where the cable then rides on the pulley. The carabiner mechanism includes a lock with a spring closure that shuts a gate 1006 after the cable is clipped onto the pulley. In some embodiments, the face of the carabiner is sized such that a ball stop (as described above) is larger than the opening, preventing a cable from retracting. In this example, the combined carabiner-pulley is able to move. For example, the carabiner-pulley may pivot about joint 1008. In this example, the carabiner-pulley is attached to an arm 1110 that may be mounted to the wall.

Pulley with Slot

Figure 11:
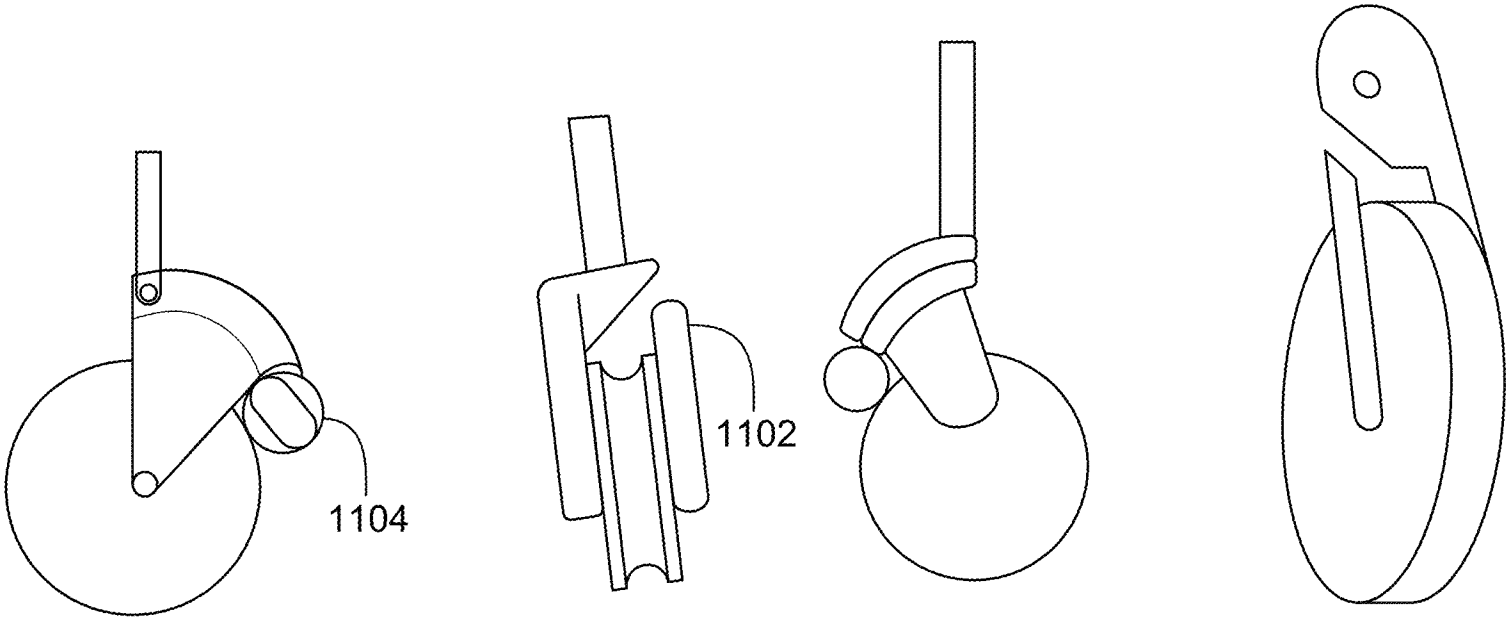
FIG. 11 illustrates an embodiment of an auxiliary pulley.

FIG. 11 illustrates an embodiment of an auxiliary pulley. In this example, the pulley includes an opening on one side into which a cable may be slipped over. As shown at 1102, the rope slides into a slot or opening between a cover and the pulley. A ball stop 1104 (as described above) attached to the user end of the cable prevents the cable from retracting. The entire assembly, including the pulley, may be attached to the wall (e.g., to a wall stud).

Mounting of Wrist-Type Pulley

As described above, in some embodiments, the user origination point is a configurable "wrist" to allow local rotation for guiding the cable.

In some embodiments, the wrist is a detachable component/assembly that may be attached or clipped into wall mounted slots. In this example, the user does not directly deal with the cable (e.g., sliding it over a pulley), but rather interacts with the entire wrist assembly.

Figure 12A:
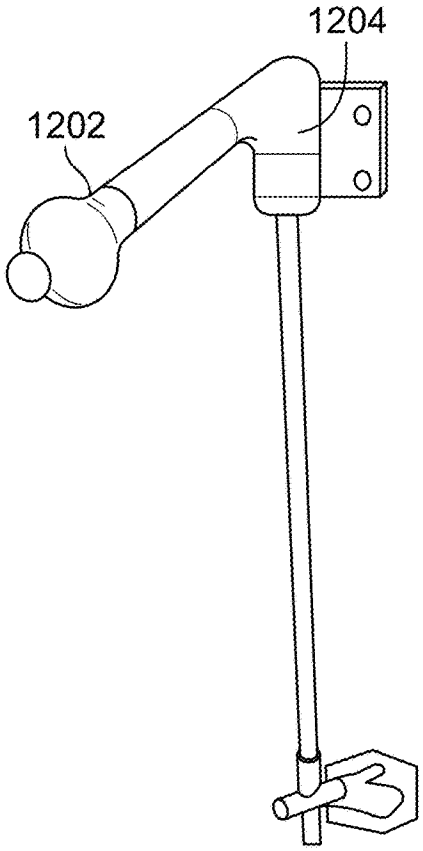
Figure 12A:
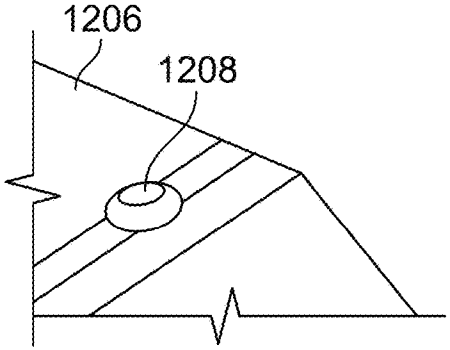

FIGS. 12A and 12B illustrate embodiments of an attachable/detachable wrist for adjusting cable pull points. As shown in the example of FIG. 12A, a wrist 1202 may be attached to a wall-mounted arm 1204. As shown in this example, the wrist is redirected from cable exit portal 1208 of platform 1206. In some embodiments, a cable extension is used to extend the cable to the upper auxiliary pulley. In the example of FIG. 12B, the wrist 1210 slots into mount 1212 via pin 1214, securing the wrist assembly to the mount (which may be wall mounted).

As shown in the examples of FIGS. 12A and 12B, rather than performing threading of a rope or cable over a pulley, the floor-based motorized device includes a block or unit or module that contains the pulley (e.g., wrist with pulley sheaves). When setting up for pull-down exercises, the entire block containing the pulley is separated from the platform and then attached to a receptacle on the wall. That is, in this example, the entire function or module is integrated into, but able to be separated from, the platform, and then taken out and attached to a wall (e.g., clicked into a hook on the wall) when needed. In some embodiments, hooks attached into the wall or onto a door frame or other mounting surface are used to provide a place onto which a module (such as the wrist described herein) is connected.

Pull-Up Bar with Pulleys

Figure 13A:
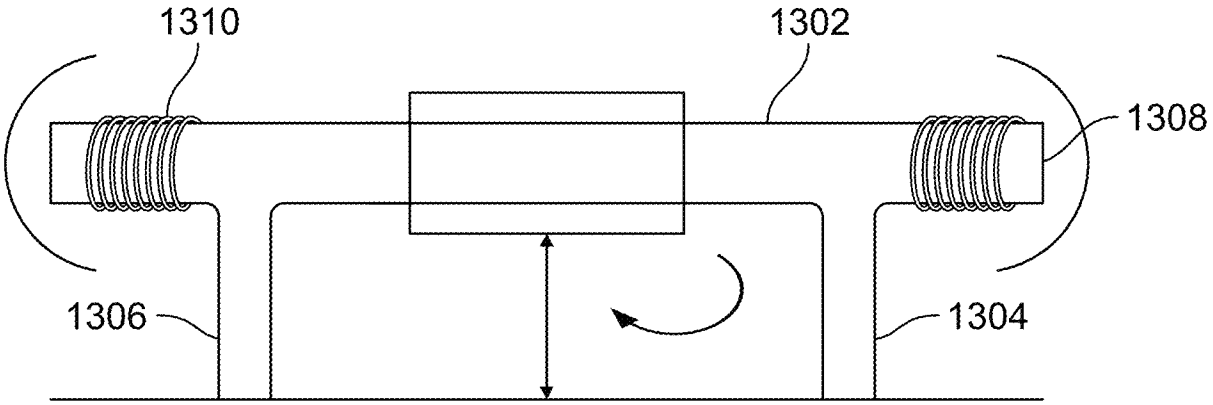
FIG. 13A illustrates an embodiment of a wall mountable bar with pulleys.

FIG. 13A illustrates an embodiment of a wall mountable bar with pulleys. In this example, a pull up bar-style bar 1302 includes two supports 1304 and 1306 that may be mounted to the studs in a wall. The pull up bar has pulleys on two ends (1308 and 1310).

With the pull up bar type system shown in this example, the pulleys need not be at the locations of the studs. This provides improved flexibility on placement of the pulleys. In some embodiments, the pulleys are adjustable along the ends of the bar. This provides a horizontal track that allows adjustability in the placement of the pulleys.

Figure 13B:
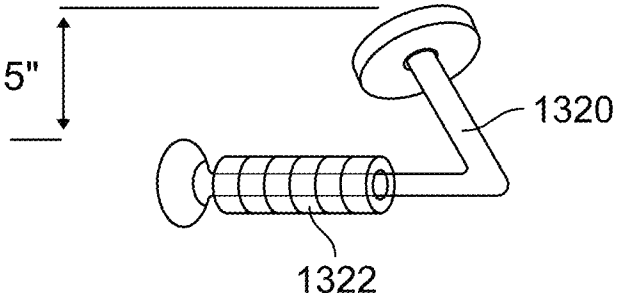
FIG. 13B illustrates an embodiment of an auxiliary pulley.

The two pulleys need not be connected. FIG. 13B illustrates an embodiment of an arm support with pulley. In this example, an L-shaped bar/arm (1320) with its own pulley 1322 may be mounted to the wall.

In some embodiments, as the pulleys in the examples of FIGS. 13A and 13B will be extended from the wall, multiple supports in multiple directions are used to allow for support in both horizontal and vertical directions.

Tracks

In some embodiments, tracks may be mounted vertically along a wall stud. An auxiliary pulley may be placed along the track, allowing a user to select different vertical heights for their pulleys.

In some embodiments, a track may be mounted horizontally between two studs. This allows a user to pick different widths between two auxiliary pulleys.

In some embodiments, a frame that includes both vertical and horizontal tracks may be mounted on a wall. Pulleys may then be slid into various predefined locking positions along the tracks.

Door Trim Molding

As another example, the secondary attachment point for auxiliary pulleys may be a door or door frame. Having the auxiliary pulley mountable to a doorway allows the performance of pull-down movements as described above. This would avoid screwing a pulley into a wall. For example, the pull-up bar style mechanism of FIG. 13A may be adapted to hang on the trim or molding around a door. In some embodiments, the bar style mechanism of FIG. 13A may be adapted to rest on the floor and be secured to the bottom of the door. This allows multiple attachment points (e.g., at the top and/or bottom of a door frame). In other examples, the secondary pulleys are mounted on poles.

As shown throughout the above examples, auxiliary pulleys may be integrated into various components, such as tracks, floors, doors, walls, etc.

Modularity

Figure 14:
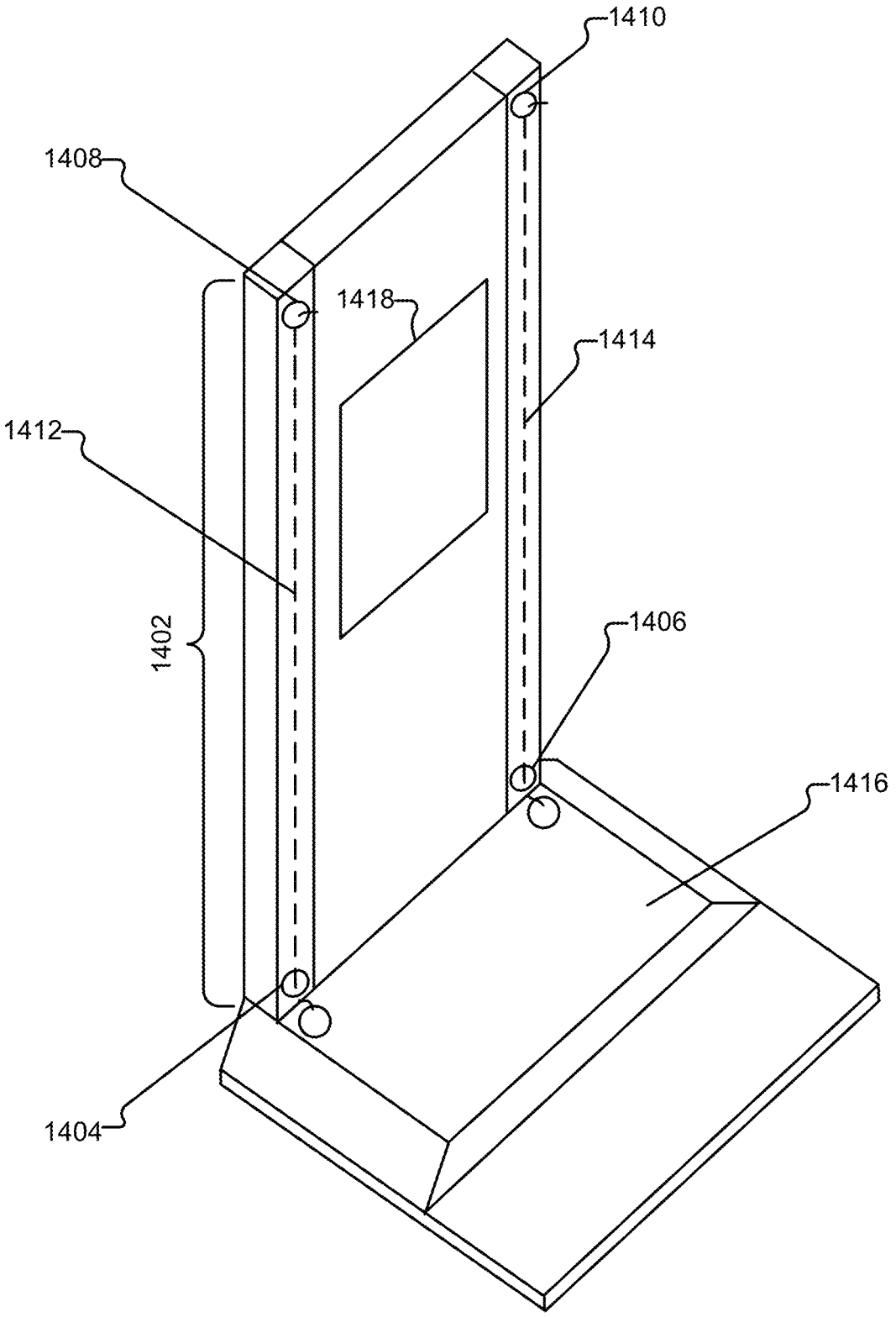
FIG. 14 illustrates an embodiment of a modular strength training system.

FIG. 14 illustrates an embodiment of a modular strength training system. In this example, a frame 1402 is pre-installed on a surface such as a wall (e.g., mounted to the studs in the wall). On each side of the frame, there is a low pulley and a high pulley (inside the frame) that is above the low pulley. To perform high exercises, a user attaches a handle to an attachment point at the top of the frame.

In this example, there are entry points into the frame at the bottoms (1404 and 1406) at the location of the bottom pulley. In this example, the frame includes two cables (1412 and 1414), one on each side. In this example, to couple the platform 1416 with the frame, the user places the platform up against the wall, below the frame. The user then attaches the cable from the platform to the frame. For example, a ball stop such as that described above is coupled to a lock that is presenting itself at entry point (1404). The user attaches an actuator such as a handle to the top attachment point (e.g., at 1408 or 1410). The user may then pull down on the actuator to perform pull down exercises. In this way, the frame becomes an accessory to the platform, where the various pulleys are hidden.

In some embodiments, the left and right sides of the frame include tracks, such that the top attachment points may be translated vertically to different heights. In this example, the frame also includes a place for a screen 1418. In some embodiments, a bench may also be added to the modular system.

With such a modular system, the user may first buy the platform, then purchase the wall mounted frame to be able to perform pull down exercises, then add a modular touch-screen to the frame, as well as add a bench to the modular strength training system.

In this example modular system of FIG. 14, the motor unit is in the platform, and is transportable separate from the frame, which may include a screen. As the motor and screens may be separated, this allows flexibility in settings such as gyms. For example, the gym may have multiple wall mounted stations (with or without screens). There may be multiple platforms that may be intermixed with the wall mounted stations. Platforms may automatically pair with wall mounted stations (e.g., via Bluetooth, pairing on physical connections of ball stops to locks of wall mounted stations, etc.).

In some embodiments, the frame described above is coupled directly to the platform (e.g., to long, stable platforms such as that shown in FIGS. 6B and 7A). Adding such a modular frame allows for holding of a screen, as well as the ability to add pull points (also referred to herein as "exertion" points) at waist height and head height. In some embodiments, such a modular frame is coupled to a platform such as that shown in FIG. 7A, which includes a track. In this example, the modular frame includes tracks that are joined to the tracks for the cart. In this example, the cart may then be translated along the platform and up into the frame.

Coupling

The following are further examples and embodiment of coupling a platform digital strength trainer for exercises beyond those on which a user stands on the platform and pulls.

In some embodiments, the platform is coupled to a bench or incline bench to allow a user to perform bench-type exercises. In some embodiments, the platform may be coupled to free weight exercise equipment and/or other cable training equipment to allow for special digital weight modes, form detection, data capture, etc. For example, the platform may be coupled to a free weight bar. In some embodiments, the platform is configured to detect and identify the characteristics of a free weight being used. For example, a user may input to the platform the weight of any free weights being used. As another example, a camera communicatively coupled with the platform is used to automatically detect weight plate sizes placed on a bar. Stickers, colors, or other visual indicators may be used to assist in automatic detection of the amount of weight being used. As described above, in some embodiments, the platform includes pressure sensors. In some embodiments, the pressure sensors of the platform are used to measure the weight of the free weight equipment. For example, the user may place the free weight they are using on the surface of the platform. The platform, using pressure sensor measurements, determines the weight of the free weight to be used.

Additional Platform Configurations

The following are additional embodiments of platform-based exercise configurations.

Figure 15:
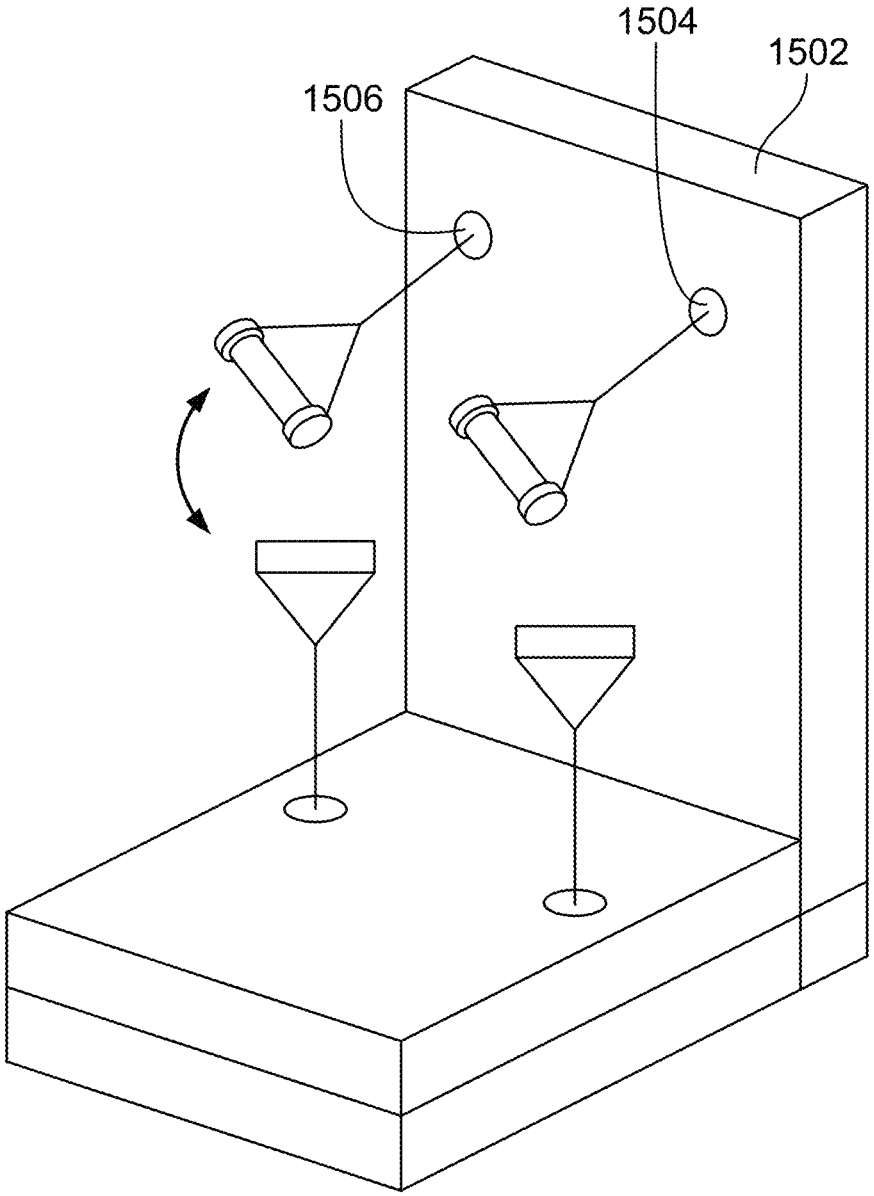
FIG. 15 illustrates an embodiment of a platform including an upright portion.

FIG. 15 illustrates an embodiment of a platform including an upright portion. In this example, the upright or vertical portion 1502 also includes portals/pull points 1504 and 1506 from which handles may be pulled out. In some embodiments, each pull point is associated with a respective motor.

Figure 16:
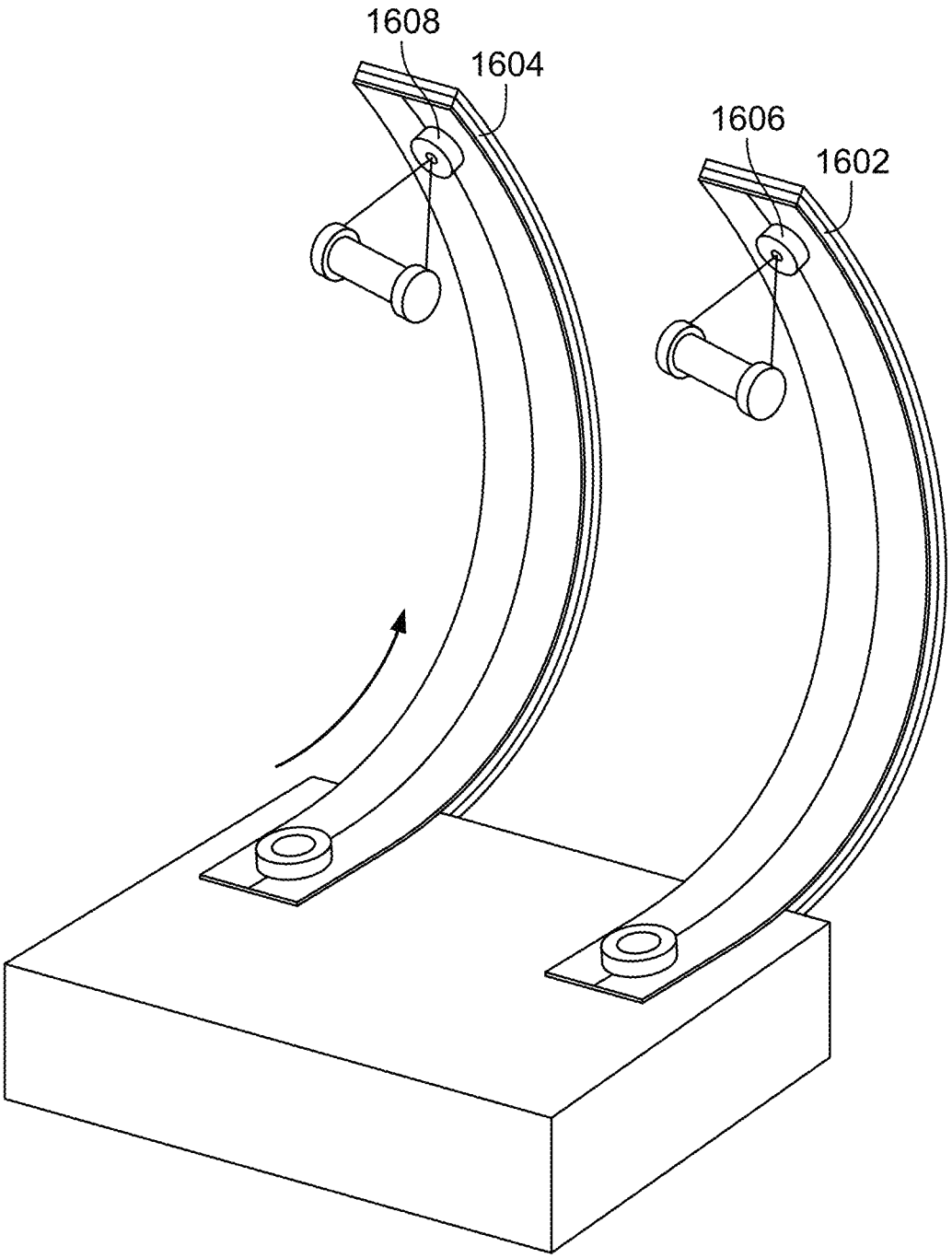
FIG. 16 illustrates an embodiment of a platform with curved tracks.

FIG. 16 illustrates an embodiment of a platform with curved tracks. In this example, the platform includes two tracks (1602 and 1604) for ball stops (1606 and 1608) such as those described above. As shown in this example, the pull points are adjustable along the curved tracks, allowing the pull points to be repositioned for performing various types of exercises.

Figure 17A:
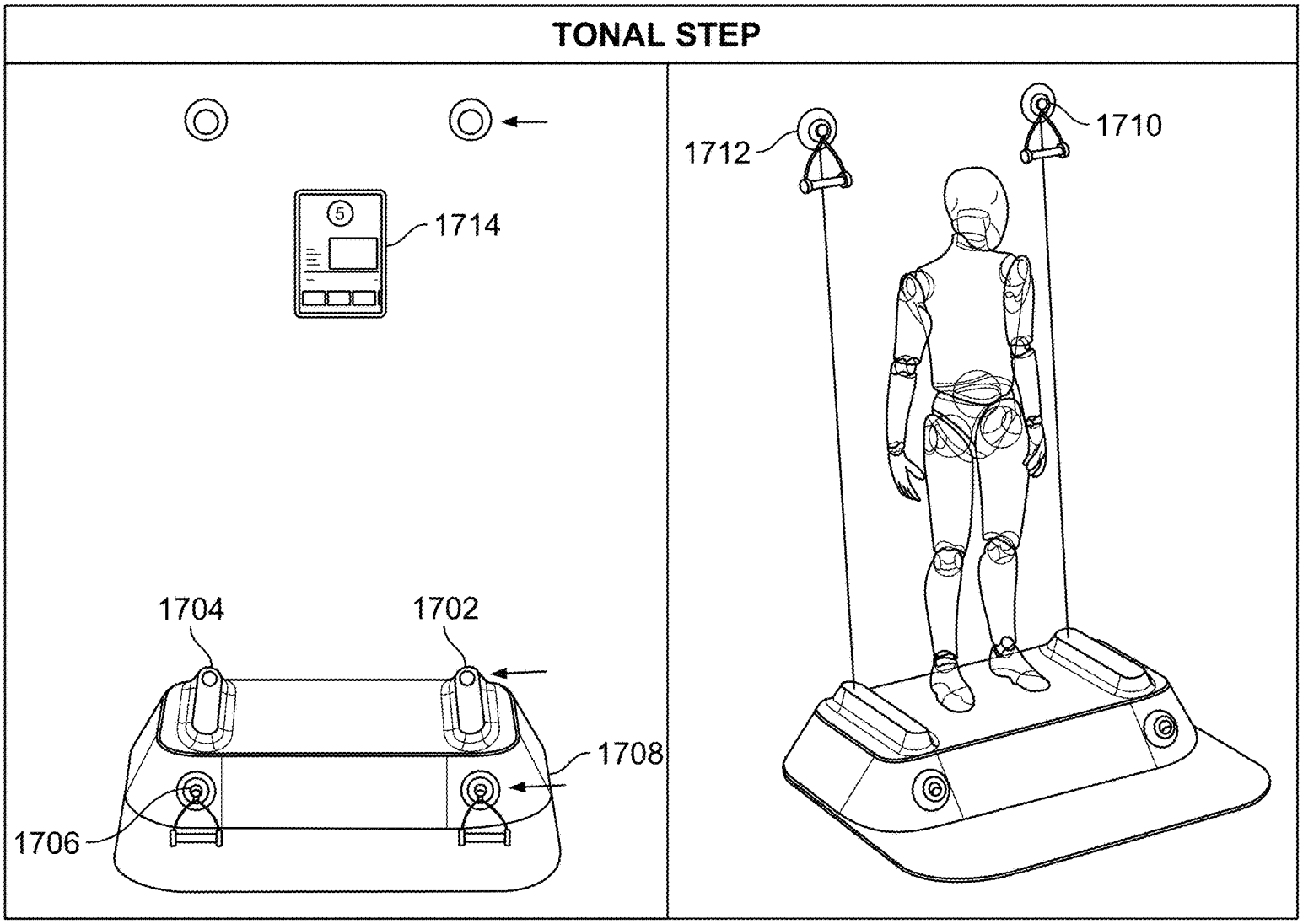
FIG. 17A illustrates an embodiment of a platform-type digital strength trainer.

FIG. 17A illustrates an embodiment of a platform-type digital strength trainer. As shown in this example, the user stands on the platform. The platform includes componentry for providing digital strength training (e.g., motors, processors, controllers, etc. as described above). As shown in this example, the platform/step includes four pull points from which cables are pulled out from the platform when performing exercises or movements. As shown in this example, the pull points on a platform digital strength trainer may be in various places. For example, as shown in the example platform of FIG. 17A, there may be pull points on top of the machine (e.g., as shown at 1702 and 1704), as well on the face of the machine (e.g., as shown at 1706 and 1708). The pull points on the face of the machine may be included to facilitate floor exercises such as seated rows. When performing such an exercise, the user may place their feet in the center of the face of the platform, with their body back, and then may pull back and forth in that position to simulate a rowing motion. With the cable pull point on the face of the platform, loads are in line, preventing overturning (which may occur if attempting to perform such floor exercises with cables that pull out from the top of the machine, which may result in an overturning moment). The platform digital strength trainer may include any number of pull points in any number of places on the platform.

As shown in the example of FIG. 17A, and as described above, the platform may be used in conjunction with secondary pulleys (e.g., auxiliary pulleys 1710 and 1712) to provide increased versatility, such as for top reach exercises. Further, as shown in the example of FIG. 17A, and as described above, the platform may be used in conjunction with a screen 1714 (that, for example, may be provided by a user).

Figure 17B:
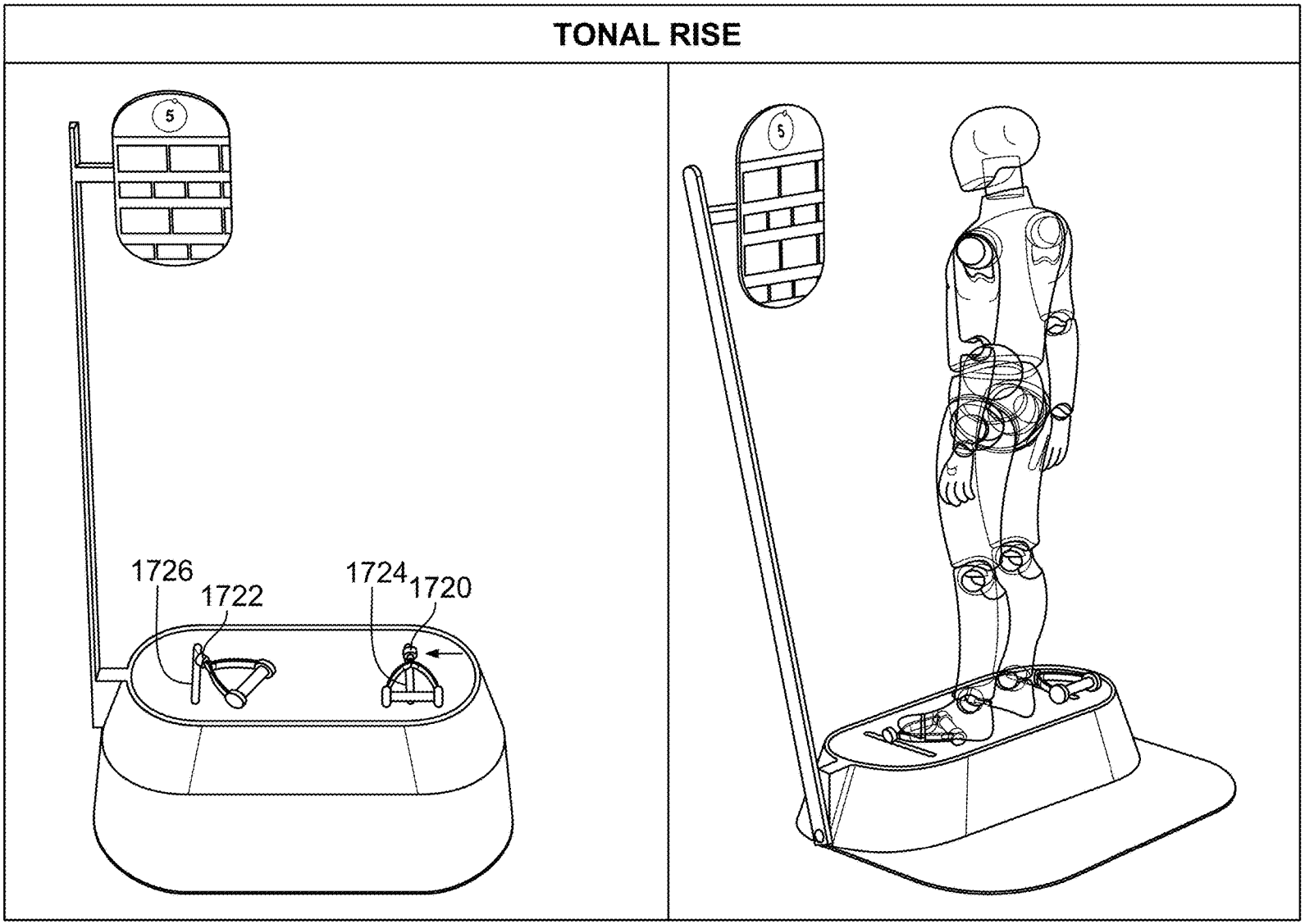
FIG. 17B illustrates an embodiment of a platform/stand-on digital exercise machine.

FIG. 17B illustrates an embodiment of a platform/stand-on digital exercise machine. In the example of FIG. 17B, the exercise machine includes two pull points 1720 and 1722 that exit out of portals at the top surface of the platform. As shown in this example, the pull points 1720 and 1722 are able to travel along slots 1724 and 1726, respectively, to allow guiding of the cable, as described above.

Figure 17C:
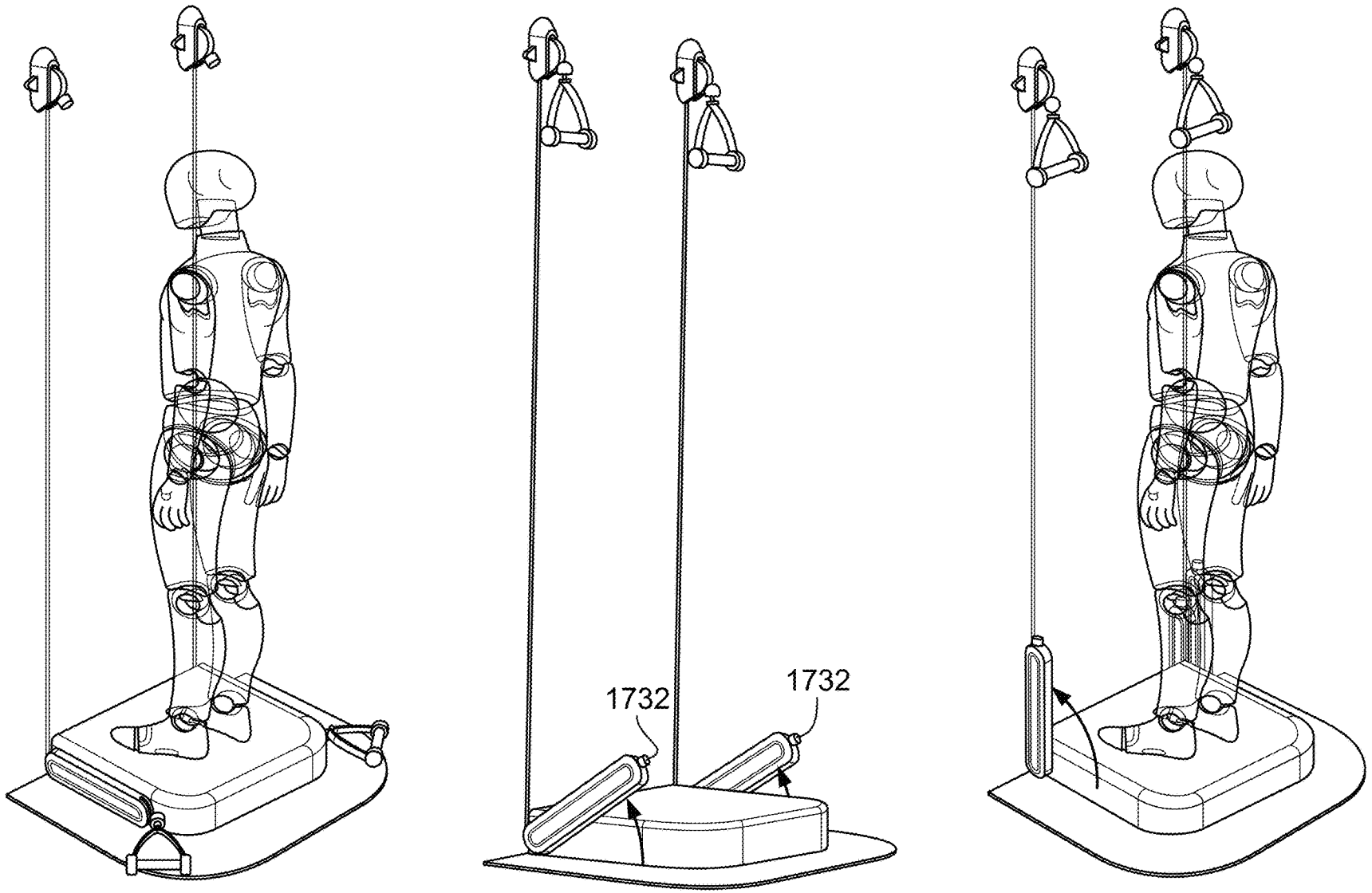
FIG. 17C illustrates an embodiment of a platform digital exercise machine.

FIG. 17C illustrates an embodiment of a platform digital exercise machine. In the example of FIG. 17C, the exercise machine includes two pull points. The exercise machine of FIG. 17C also includes two adjustable arms 1730 and 1732 to allow for Z-axis rotation. As shown in this example, and as described above, the platform of FIG. 17C may be used in conjunction with pulleys to allow for top reach.

Figure 17D:
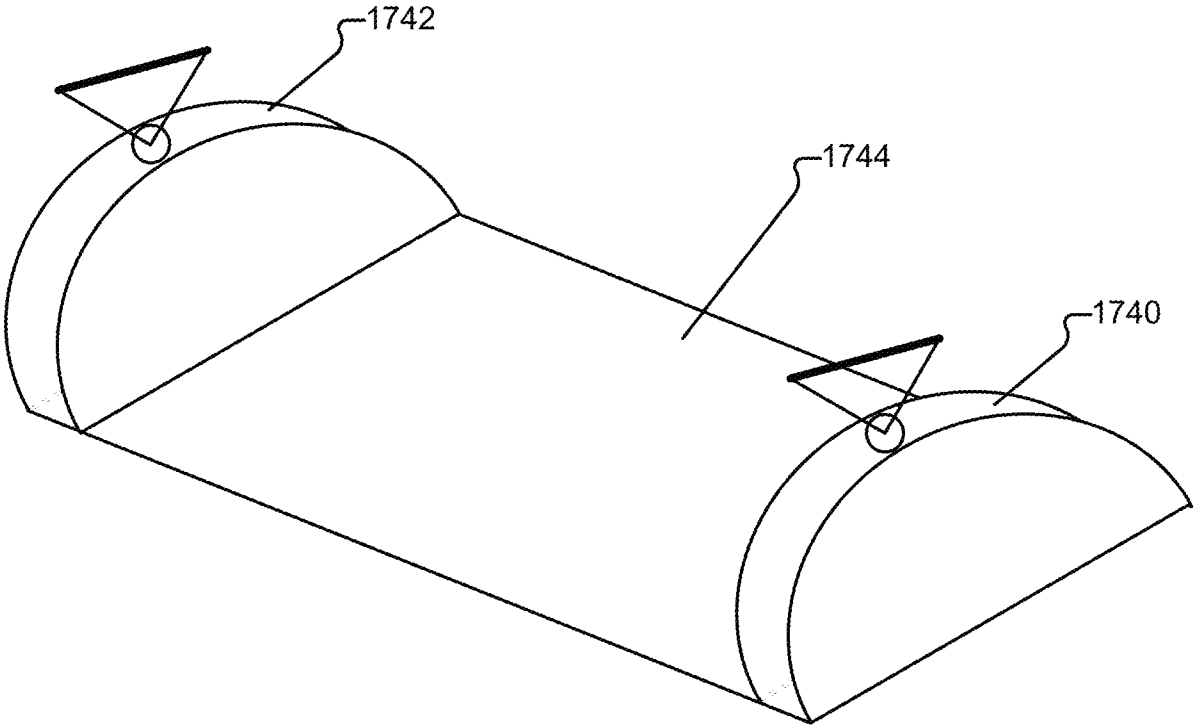
FIG. 17D illustrates various embodiments of a platform-style digital exercise machine.

FIG. 17D illustrates an embodiment of a platform-style digital exercise machine. As shown in this example, the platform includes two raised portions 1740 and 1742 for housing individual internal motors. The user than stands on center portion 1744 when performing exercises.

Figure 17E:
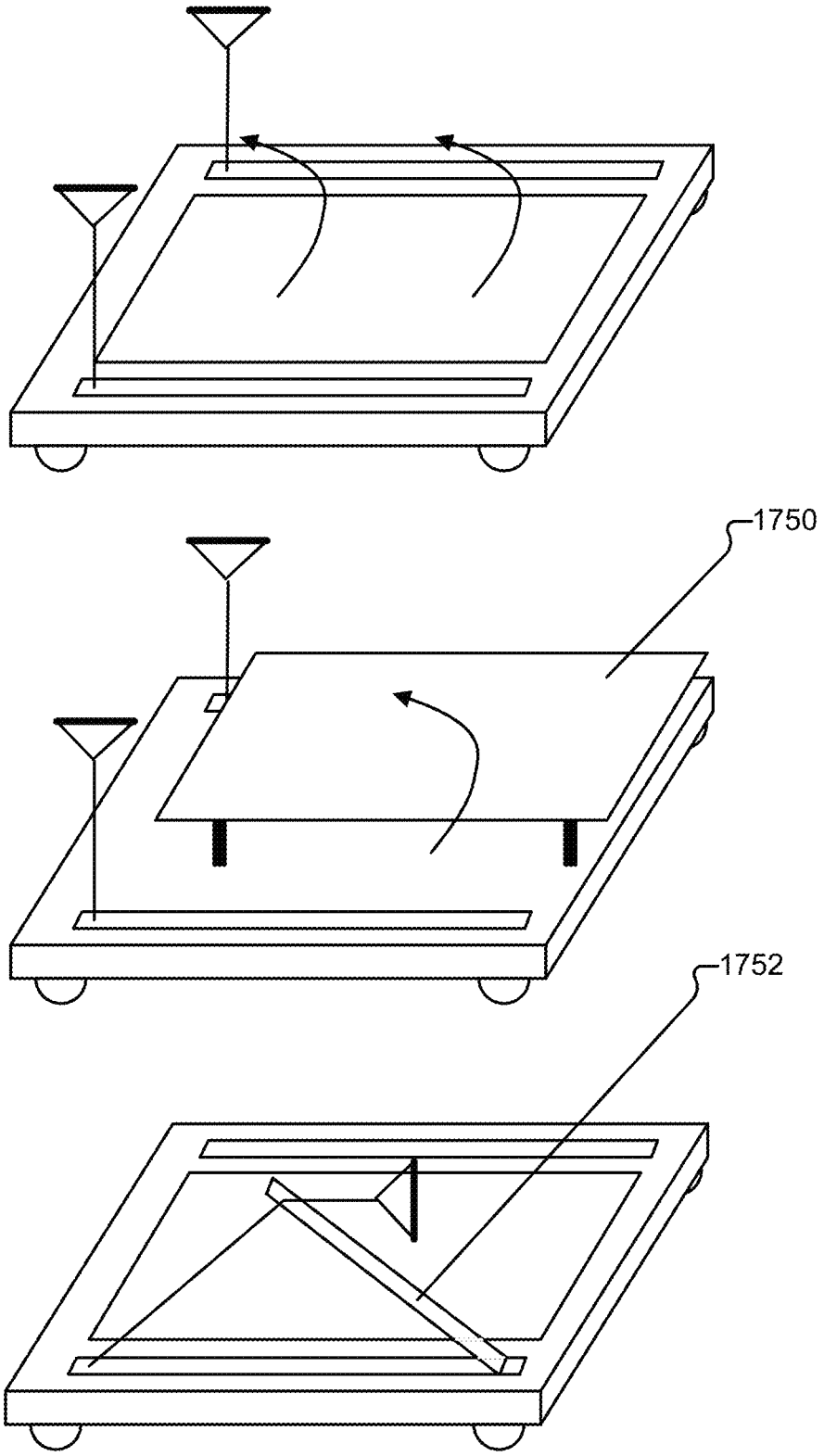
FIG. 17E illustrates various embodiments of a platform-style digital exercise machine.

FIG. 17E illustrates an embodiment of a platform-style digital exercise machine. In this example, the platform includes a collapsible bench (1750), as well as collapsible arms (1752). This allows the platform to be converted into various configurations to perform different exercises.

Figure 17F:
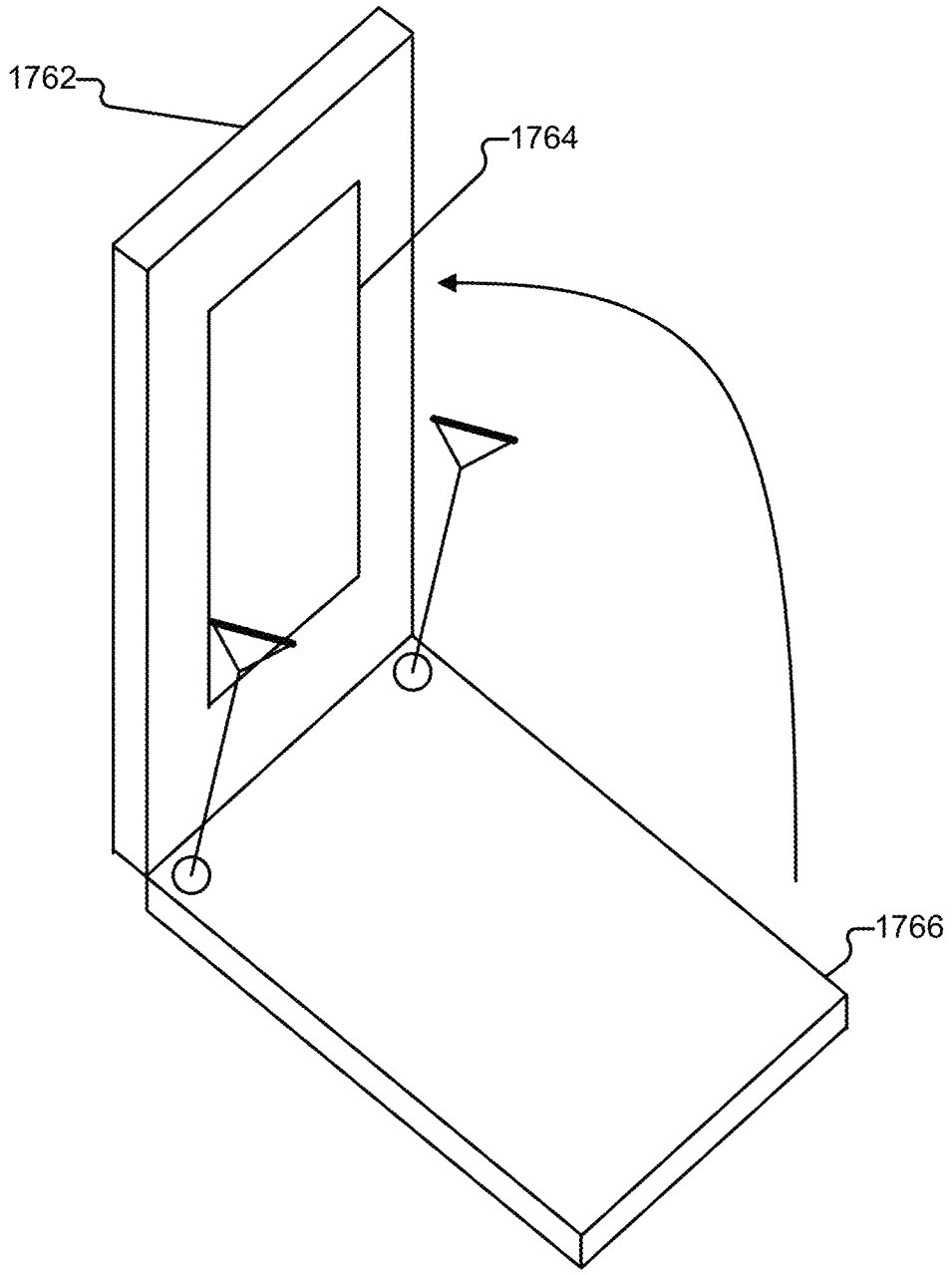
FIG. 17F illustrates various embodiments of a platform-style digital exercise machine.

FIG. 17F illustrates an embodiment of a platform-style digital exercise machine. In this example, the exercise machine includes a wall mounted frame 1762. In this example, the wall mounted frame includes a screen 1764. In this example, the platform portion 1766, which includes internal motors and cable exit portals and pull points, may be stowed by folding the platform up and locking the platform to the frame.

The various embodiments of floor-based exercise machines shown in the examples of FIGS. 17A-17F may be used in conjunction with integrated or separate screens.

Figure 18A:
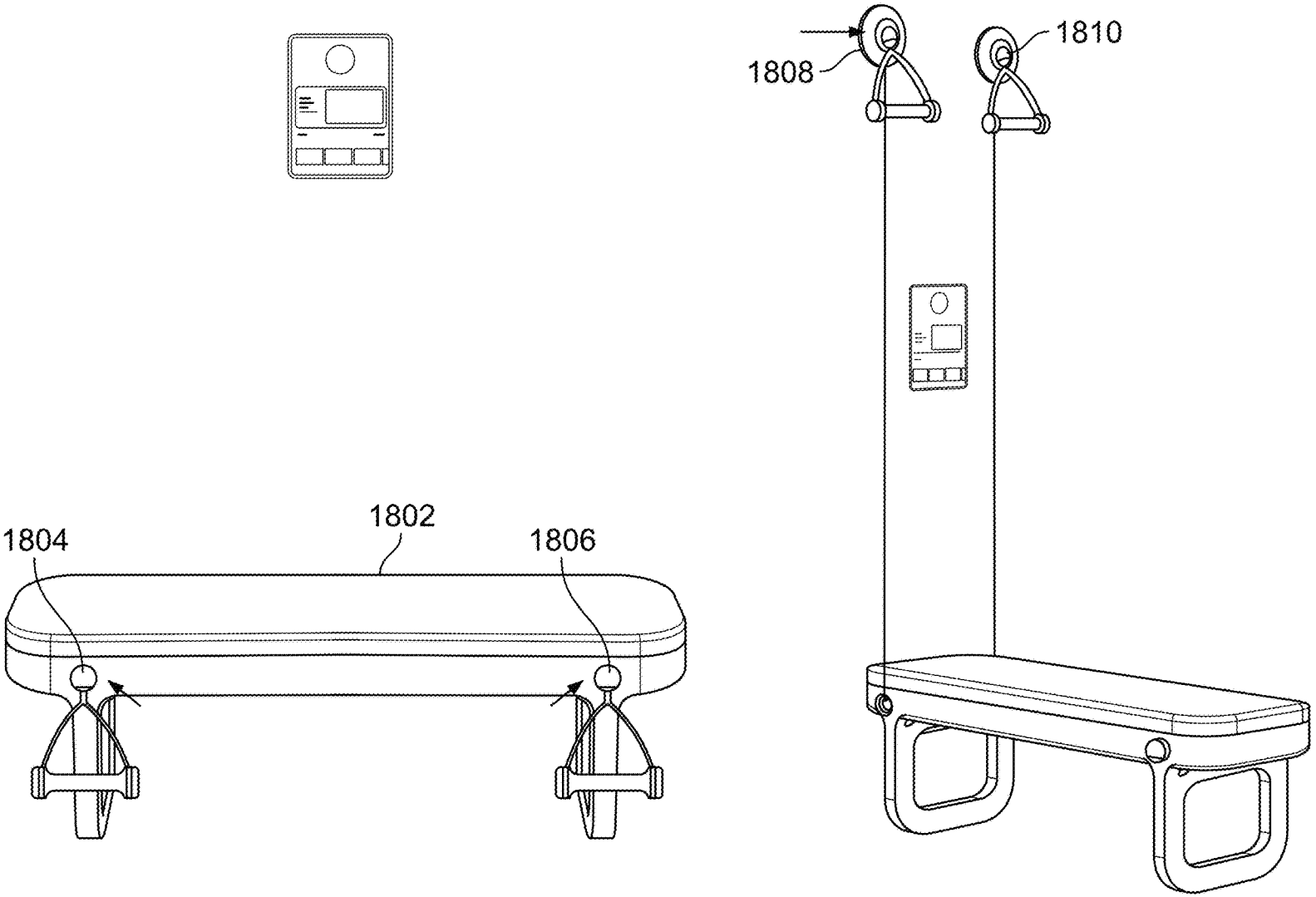
FIG. 18A illustrates an embodiment of a bench digital exercise machine.

FIG. 18A illustrates an embodiment of a bench digital exercise machine. As shown in this example, the motors and other components of an exercise machine such as a digital strength trainer described above are embedded in a bench 1802. In this example, the bench has multiple pull points. For example, in this example, the bench has 4 pull points, with two on each side of the bench (e.g., pull points 1804 and 1806). In the example of a bench, the handles may be attached to the ends of cables that come out from the various pull points to perform various exercises. With a bench, the user may sit on the bench, lie down on the bench, etc. to perform various exercises. As shown in this example, the cables from the bench may be redirected to auxiliary pulleys 1808 and 1810 to allow pull down exercises.

FIG. 18B illustrates an embodiment of a convertible platform and bench digital strength trainer. As shown in the example of FIG. 18B, the bench 1820 may be placed in various configurations by folding in the legs 1822 and 1824. For example, when the legs are folded in, the bench becomes a platform that the user may stand on to perform exercises. As shown in the examples of FIGS. 18A and 18B, the bench digital exercise machine may be used in conjunction with auxiliary pulleys, as well as connectively coupled to a screen (which may be brought by the user or purchased as an add-on (e.g., as a modular touchscreen), and separate from the bench). In other embodiments, the bench does not have leg extension cams, and does not have foldable legs.

The convertible bench/platform configuration provides various benefits, as the strength training device may be adjustable for standing on, sitting on, laying on, etc., providing flexibility and range in the number of exercises that may be performed. In some embodiments, upright posts coupled to the bench are used to support movements requiring higher pull points, while also simultaneously providing stability.

In another embodiment, the digital strength trainer is in the form of an office chair, which allows a person to work out at their desk. In this example, the motors and other components of an exercise machine such as a digital strength trainer are embedded in the chair.

Figure 19:
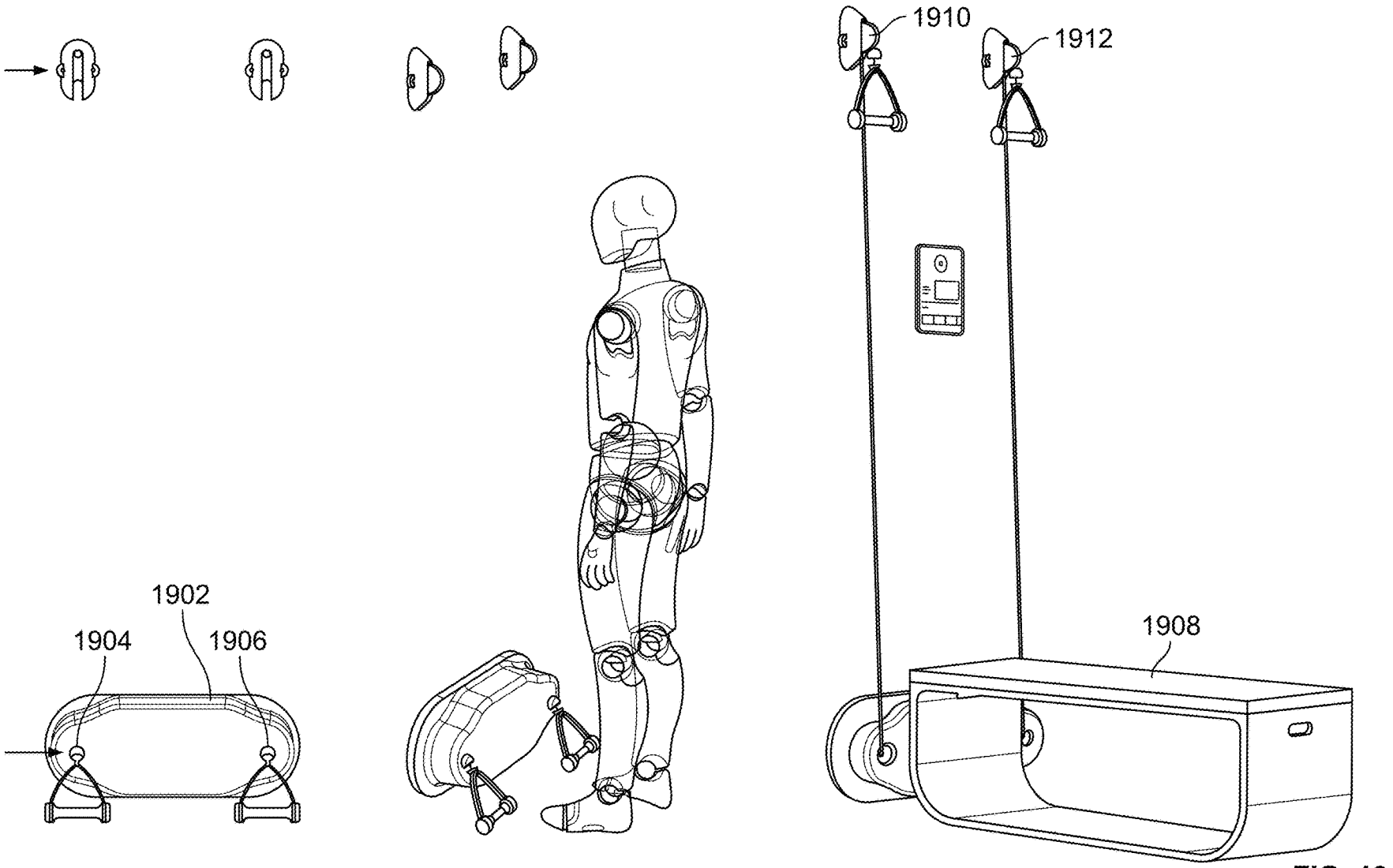
FIG. 19 illustrates an embodiment of a digital exercise machine.

FIG. 19 illustrates an embodiment of a digital exercise machine. As shown in this example, the motorized device that includes the components for a digital strength trainer are encapsulated in a single unit 1902 that may be wall mounted low on a wall. This provides an exercise machine with a small footprint. In this example, the unit includes two pull points/cable exit portals 1904 and 1906 from which cables are pulled out. As shown in this example, the minimal exercise machine may be used in conjunction with another accessory such as a bench 1908. As shown in this example, the exercise machine of FIG. 19 may be used in conjunction with auxiliary pulleys (e.g., auxiliary pulleys 1910 and 1912) for mid and top reach.

FIGS. 17A-17F, 18A-18B, and 19 illustrate examples of using floor-based digital exercise machines (where motors are placed down low) with auxiliary pulleys that are mounted higher up. While the examples shown include two auxiliary mount points for pulleys, the auxiliary pulleys may be placed at different positions, where multiple auxiliary pulleys may be used to provide multiple pull points (e.g., to provide two low pull points, two middle pull points, two high pull points, etc.).

User Control Interface

Various types of control mechanisms may be provided to control the behavior of the platform, such as indicating what the next movement is, moving to the next move, adjusting weight, adjusting playback of virtual exercise content (e.g., skip ahead, pause, play, etc.), etc.

Remote Device/Displays

In some embodiments, the various floor-based devices described herein communicate with a display. The display, such as a touchscreen display, may be used to provide a user interface by which to control the settings of the floor-based machine. The display may also be used to present content such as audiovisual content (e.g., a virtual workout routine). As will be described in further detail below, the display may be a device that a user brings themselves, such as a tablet device, a display or screen (e.g., touchscreen) integrated into components of the digital strength trainer, etc. The display or screen may be coupled with the digital exercise machine via a wired or wireless connection. For example, as shown in the examples of FIGS. 17A, 18A, 18B, and 19, the exercise machine may be wirelessly coupled to a screen or display that the user brings themselves.

In some embodiments, the platform is paired with a remote device such as a tablet, smartphone device, smart watch, etc. The platform may then be controlled from the remote device. The remote display or screen may be used to provide instructions to a user, such as indicating what to do next in a workout. For example, a tablet may be placed on the wall, as shown in the example of FIG. 17A, and used to control the platform's behavior. The platform may also include a stand for holding a tablet. For example, the remote device may communicate wirelessly with the platform (e.g., via a protocol such as Bluetooth or other type of robust low latency wireless protocol). As another example, the platform may be communicatively coupled with a smart watch, where the watch display may be used to provide instructional information such as what movement is next. The watch may also be used to control the platform.

FIG. 17B illustrates an embodiment of a digital exercise machine that includes an adjustable screen on a stand. In some embodiments, the screen stand is folded out and is stabilized by the platform. The screen stand brings the screen to, for example, mid-body height. In some embodiments, the platform strength trainer is modular, and a separate stand for a screen may be used, allowing greater flexibility for positioning.

In some embodiments, a display or screen is integrated with the pulleys that are secondarily mounted. For example, in the case of auxiliary wall pulleys, the screen may be integrated with the wall pulleys as a single unit that is attached to the wall. In some embodiments, the unit that includes the wall pulleys includes a holder for a device such as a tablet that a user provides themselves.

Figure 20:
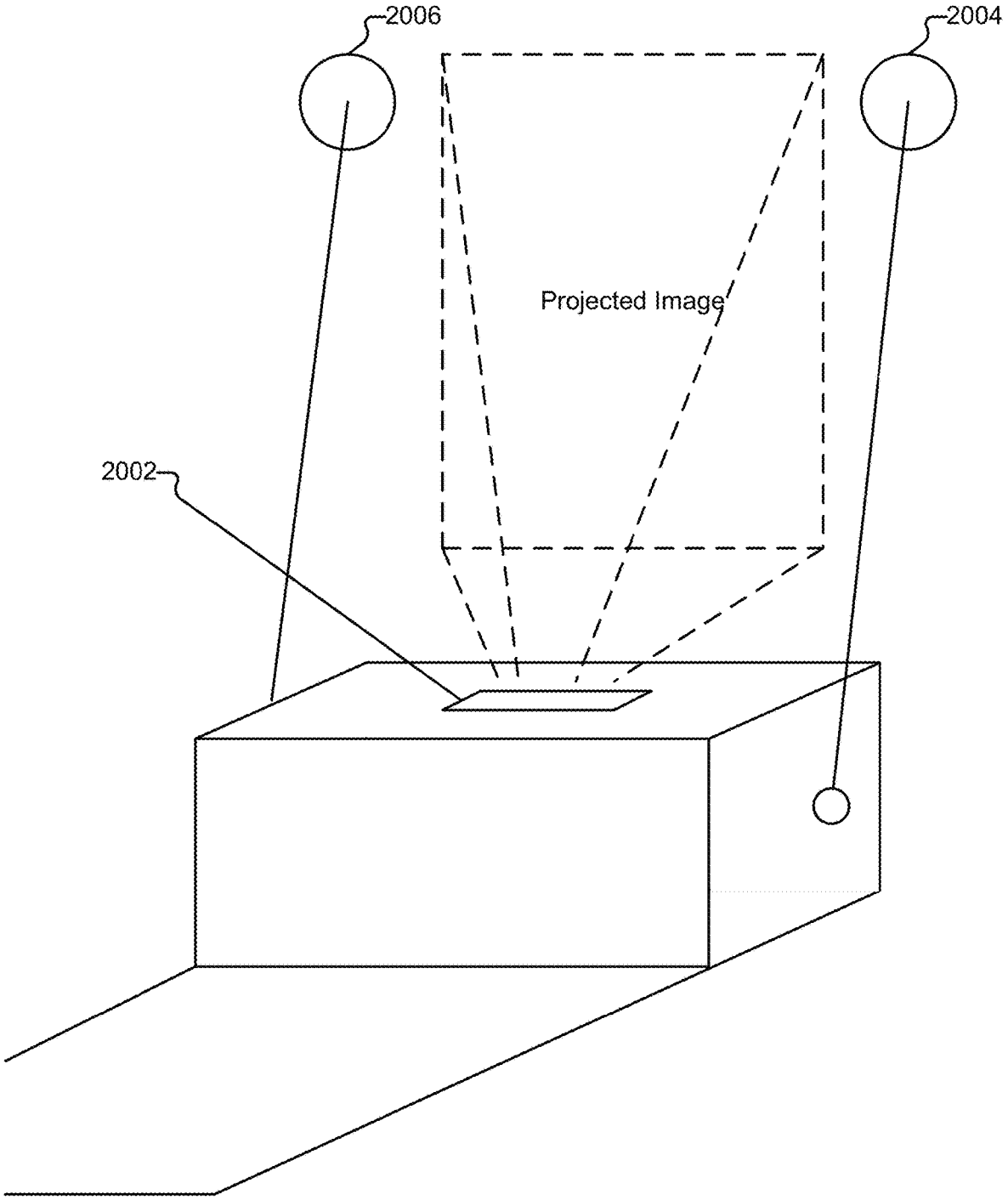
FIG. 20 illustrates an embodiment of an exercise machine system including a projector unit.

FIG. 20 illustrates an embodiment of an exercise machine system including a projector unit. In this example, the exercise machine system includes or communicates with a projector unit 2002 that projects a display onto a surface such as a wall. For example, the projector is used to project a display onto the wall where auxiliary pulleys (2004 and 2006) are placed and used as anchor points. The projector may be in its own unit or module. In other embodiments, the projector is integrated with the floor-based exercise machine. For example, the projector may be included in the bulge or housing that includes components such as motors, where the platform includes a lower plate on which the user stands. As another example, the projector is integrated into an end of an exercise machine such as the bench of FIGS. 18A and 18B.

In other embodiments, the digital exercise machines communicate with smart glasses that provide augmented reality functionality. For example, the glasses may be at least partially transparent and project images during a workout to allow a user to visually follow along with a trainer (rather than, for example, looking at a screen).

Foot Control

In some embodiments, the platform includes foot-based controls. For example, the surface of the platform may include a set of buttons which the user can press on to pause or start a workout routine. Foot controls are one example of an interface that is built into the platform. The foot-based controls may be used to perform actions such as start, stop, weight up, weight down, etc.

Different foot buttons may be included to control different aspects of the platform. For example, a button may be used to adjust weight. Another button may be used to move ahead in a workout, or stop or pause the workout. Context-based buttons may be used, in which the function of the button changes depending on context.

Smart Actuators

In some embodiments, the actuators, such as handles, used by the users are smart handles that include integrated electronics and controls for controlling the platform. For example, the handles may connect to the platform wirelessly over a protocol such as Bluetooth. The handles may include buttons or other types of controls (e.g., microphones for accepting voice inputs and commands) for taking user input and transmitting instructions to the platform (e.g., to rack or unrack weight).

Integrated Screen

In some embodiments, the platform includes an integrated screen that indicates status information, such as the next move to be performed. The screen may be used to provide a guide of what is upcoming in a user's workout, the number of repetitions performed, the amount of digital weight being provided (which would allow the user to check whether the weight they will be resisting is a safe amount), etc.

In embodiments of a platform with a bulge to accommodate vertically mounted motors, the screen may be incorporated into the bulge or other portion of the platform that a user typically does not step on.

Audio Cues

In some embodiments, the platform includes one or more integrated speakers to provide audio instructions, such as audio cues. In this way, a mobile device need not be required for use with the platform. For example, audio instructions may be sufficient for most types of instructions and feedback.

As described above, the floor-based strength trainer configurations described herein provide various benefits, such as ease of movement, as well as ease of storage. In some embodiments, power is provided to the platform by plugging the platform into an outlet. In other embodiments, the platform includes an integrated battery that may be charged. The use of a battery allows the platform to be fully autonomous. In some embodiments, power generated by users is recaptured to extend usage time.

Although the foregoing embodiments have been described in some detail for purposes of clarity of understanding, the invention is not limited to the details provided. There are many alternative ways of implementing the invention. The disclosed embodiments are illustrative and not restrictive.

What is claimed is:

1. An exercise machine, comprising:

a platform that includes a first vertically oriented motor and a second vertically oriented motor, wherein corresponding axes of rotation associated with the first vertically oriented motor and the second vertically oriented motor pass through a front of the platform, wherein the first vertically oriented motor is associated with a first cable and the second vertically oriented motor is associated with a second cable, wherein the platform includes a front raised housing portion for the first vertically oriented motor and the second vertically oriented motor and a lower exercise portion configured for a user to utilize the exercise machine to perform one or more different exercises;

a frame that includes a first track that includes a first plurality of attachment points and a second track that includes a second plurality of attachment points;

a first stopper coupled to the first cable at a first attachment point, wherein the first attachment point is capable of being vertically translated between the first plurality of attachment points; and a second stopper coupled to the second cable at a second attachment point.

2. The exercise machine of claim 1, wherein the first stopper enables a first actuator to be coupled to the first cable at the first attachment point.

3. The exercise machine of claim 2, wherein the first actuator is a handle, a bar, rope, or a strap.

4. The exercise machine of claim 1, wherein the second stopper is substantially spherical in shape.

5. The exercise machine of claim 4, wherein the second stopper enables a second actuator to be coupled to the second cable at the second attachment point.

6. The exercise machine of claim 1, further comprising an actuator that wirelessly communicates with a motor controller included in the platform.

7. The exercise machine of claim 6, wherein the actuator wirelessly communicates with the motor controller using Bluetooth.

8. The exercise machine of claim 6, wherein the actuator is configured to provide a signal to the motor controller that causes a digital weight associated with the exercise machine to be racked or unracked in response to a user input.

9. The exercise machine of claim 1, wherein the first vertically oriented motor and the first cable are associated with a first spool.

10. The exercise machine of claim 9, wherein the second vertically oriented motor and the second cable are associated with a second spool.

11. The exercise machine of claim 1, wherein the second attachment point is capable of being vertically translated between the second plurality of attachment points.

12. The exercise machine of claim 1, further comprising a screen located in between the first track and the second track.

13. The exercise machine of claim 1, wherein a bench or incline bench is located on top of at least a portion of the lower exercise portion.

* * * * *